US009129579B2

(12) United States Patent
Imai

(10) Patent No.: US 9,129,579 B2
(45) Date of Patent: Sep. 8, 2015

(54) DISPLAY DRIVE CIRCUIT, DISPLAY DEVICE AND METHOD FOR DRIVING DISPLAY DRIVE CIRCUIT

(75) Inventor: Masahiro Imai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/233,924

(22) PCT Filed: Jul. 31, 2012

(86) PCT No.: PCT/JP2012/069516

§ 371 (c)(1),
(2), (4) Date: Jan. 21, 2014

(87) PCT Pub. No.: WO2013/021873

PCT Pub. Date: Feb. 14, 2013

(65) Prior Publication Data

US 2014/0145921 A1 May 29, 2014

(30) Foreign Application Priority Data

Aug. 5, 2011 (JP) ..... 2011-172160

(51) Int. Cl.
*G09G 3/36* (2006.01)

(52) U.S. Cl.
CPC ..... *G09G 3/3696* (2013.01); *G09G 3/3688* (2013.01); *G09G 3/3614* (2013.01); *G09G 2310/0291* (2013.01); *G09G 2310/08* (2013.01); *G09G 2320/0247* (2013.01); *G09G 2330/021* (2013.01)

(58) Field of Classification Search
CPC ..... G09G 3/36
USPC ..... 345/87, 100
See application file for complete search history.

(56) References Cited

U.S. PATENT DOCUMENTS

| | | | | |
|---|---|---|---|---|
| 6,331,846 | B1 | 12/2001 | Nakao | |
| 6,388,653 | B1 * | 5/2002 | Goto et al. | 345/98 |
| 2002/0039096 | A1 | 4/2002 | Katsutani | |
| 2009/0040165 | A1 * | 2/2009 | Shimatani | 345/98 |

FOREIGN PATENT DOCUMENTS

| | | | |
|---|---|---|---|
| JP | 11-305735 | A | 11/1999 |
| JP | 2002-108303 | A | 4/2002 |

OTHER PUBLICATIONS

Official Communication issued in International Patent Application No. PCT/JP2012/069516, mailed on Sep. 4, 2012.

* cited by examiner

*Primary Examiner* — Grant Sitta
(74) *Attorney, Agent, or Firm* — Keating & Bennett, LLP

(57) ABSTRACT

A source driver (20) includes: a first amplifier circuit and a second amplifier circuit each amplifying either one of input signals that are in-phase and antiphase; and a switching control circuit (29) which supplies an offset switching signal (4) for switching the input signals, the switching control circuit (29) supplying the offset switching signal (4) having a higher frequency than a horizontal synchronization signal. This provides a display drive circuit capable of enhancing a display quality while preventing a flicker from occurring in an entire display screen.

12 Claims, 41 Drawing Sheets

FIG. 14

(a)

| | FIRST FRAME | SECOND FRAME | OFFSET SWITCHING SIGNAL |
|---|---|---|---|
| FIRST LINE | + | − | HHLLHHLLHHLL |
| SECOND LINE | − | + | HHLLHHLLHHLL |
| THIRD LINE | + | − | LLHHLLHHLLHH |
| FOURTH LINE | − | + | LLHHLLHHLLHH |
| FIFTH LINE | + | − | HHLLHHLLHHLL |
| ⋮ | ⋮ | ⋮ | ⋮ |

(b)

| LINE | POLARITY | OFFSET STATE |
|---|---|---|
| 4M+1<br>4M+2 | POSITIVE/NEGATIVE | $\alpha$ |
| 4M+3<br>4M+4 | POSITIVE/NEGATIVE | $-\alpha$ |

FIG. 16

(a)

| | FIRST FRAME | SECOND FRAME | OFFSET SWITCHING SIGNAL |
|---|---|---|---|
| FIRST LINE | + | − | HHLLHHLLHHLL |
| SECOND LINE | + | − | LLHHLLHHLLHH |
| THIRD LINE | − | + | HHLLHHLLHHLL |
| FOURTH LINE | − | + | LLHHLLHHLLHH |
| FIFTH LINE | + | − | HHLLHHLLHHLL |
| ⋮ | ⋮ | ⋮ | ⋮ |

(b)

| LINE | POLARITY | OFFSET STATE |
|---|---|---|
| 4M+1<br>4M+3 | POSITIVE/NEGATIVE | $\alpha$ |
| 4M+2<br>4M+4 | POSITIVE/NEGATIVE | $-\alpha$ |

FIG. 17

(a)

| | FIRST FRAME | SECOND FRAME | OFFSET SWITCHING SIGNAL | |
|---|---|---|---|---|
| | | | ODD-NUMBERED OUTPUT | EVEN-NUMBERED OUTPUT |
| FIRST LINE | + | − | HHLLHHLLHHLL | LLHHLLHHLLHH |
| SECOND LINE | − | + | HHLLHHLLHHLL | LLHHLLHHLLHH |
| THIRD LINE | + | − | LLHHLLHHLLHH | HHLLHHLLHHLL |
| FOURTH LINE | − | + | LLHHLLHHLLHH | HHLLHHLLHHLL |
| FIFTH LINE | + | − | HHLLHHLLHHLL | LLHHLLHHLLHH |
| ⋮ | ⋮ | ⋮ | ⋮ | ⋮ |

(b)

| ODD-NUMBERED OUTPUT | | | EVEN-NUMBERED OUTPUT | | |
|---|---|---|---|---|---|
| LINE | POLARITY | OFFSET STATE | LINE | POLARITY | OFFSET STATE |
| 4M+1<br>4M+2 | POSITIVE/<br>NEGATIVE | $\alpha$ | 4M+1<br>4M+2 | POSITIVE/<br>NEGATIVE | $-\alpha$ |
| 4M+3<br>4M+4 | POSITIVE/<br>NEGATIVE | $-\alpha$ | 4M+3<br>4M+4 | POSITIVE/<br>NEGATIVE | $\alpha$ |

DISPLAY DRIVE CIRCUIT, DISPLAY DEVICE AND METHOD FOR DRIVING DISPLAY DRIVE CIRCUIT

TECHNICAL FIELD

The present invention relates to a display drive circuit including a differential amplifier circuit which has an offset voltage, a display device including the display drive circuit, and a method for driving the display drive circuit.

BACKGROUND ART

The following has been known about a conventional liquid crystal display device. An offset voltage which is incidentally produced by, for example, a manufacturing variation in a differential amplifier constituting an output circuit section (output circuit 4408 of FIG. 18) of a display drive circuit (source driver 3802 of FIG. 18) causes a difference from an ideal driving voltage to be supplied to a liquid crystal display element, so that a display image is not suitably displayed, and so-called display unevenness occurs. This causes a deterioration in display quality.

For example, Patent Literature 1 describes a technique for solving display unevenness caused by such an offset voltage. The following description discusses first to third conventional techniques described in Patent Literature 1.

(a) and (b) of FIG. 19 are block diagrams each illustrating an output circuit of a source driver IC in accordance with the first conventional technique, and also illustrating an example of an operation thereof. In (a) and (b) of FIG. 19, only blocks indicated by the respective reference numerals 4405, 4407, and 4408 in FIG. 18 are shown as circuits corresponding to two output terminals.

In (a) and (b) of FIG. 19, the reference numeral 4501 indicates a voltage follower which uses operational amplifiers in an output circuit which drives an odd-numbered output terminal, the reference numeral 4502 indicates a voltage follower which uses, in an output circuit which drives an even-numbered output terminal, operation amplifiers identical to those used in the voltage follower 4501. The reference numerals 4503, 4504, 4505, and 4506 each indicate an output alternation switch for switching a polarity of an output voltage of a liquid crystal drive output. The reference numeral 4507 indicates a D/A conversion circuit which carries out digital/analog conversion with respect to a positive-polarity voltage. The reference numeral 4508 indicates a D/A conversion circuit which carries out digital/analog conversion with respect to a negative-polarity voltage. The reference numerals 4509 and 4510 each indicate a hold memory in which display data is held. The reference numeral 4511 indicates an odd-numbered output terminal, and the reference numeral 4512 indicates an even-numbered output terminal. The reference numeral 4513 in the operational amplifier 4501 and the reference numeral 4514 in the operational amplifier 4502 each indicate an N-channel MOS input operational amplifier. The reference numeral 4515 in the operational amplifier 4501 and the reference numeral 4516 in the operational amplifier 4502 each indicate a P-channel MOS input operational amplifier.

According to the above configuration, the output circuit has two operational amplifiers, which are an operational amplifier that has an N-channel MOS transistor in its input stage and an operational amplifier that has a P-channel transistor in its input stage, are provided so that both a positive-polarity voltage and a negative-polarity voltage can be supplied (full-range supplied) to one output terminal. This makes it possible to cancel deviations A and −A caused by offset voltages in two frames (see FIG. 20).

However, according to the configuration of the first conventional technique, the output circuit has two operational amplifiers per output terminal. This causes a problem of an increase in circuit scale and electric power consumption.

In view of the above, a configuration (see (a) and (b) of FIG. 21) which allows a smaller circuit scale and lower electric power consumption by halving the number of operational amplifiers is taken as an example of the second conventional technique. However, according to the configuration, two operational amplifiers (operational amplifiers 4601 and 4602) each driving one output differ between a case where a positive-polarity voltage is outputted and a case where a negative-polarity voltage is outputted. Therefore, unlike the case of the first conventional technique, it is impossible to cancel offset voltages produced by, for example, a manufacturing variation. This is specifically described below with reference to FIG. 22.

FIG. 22 shows a waveform of a liquid crystal driving voltage in a case where the operational amplifier 4601 has an offset voltage A and the operational amplifier 4602 has an offset voltage B. In FIG. 22, deviations from respective expectation voltages differ between the case where a positive-polarity voltage is outputted and the case where a negative-polarity voltage is outputted. Accordingly, a component (=(A−B)/2) of a difference between the two deviations remains as an error voltage in an average voltage of driving voltages which are to be applied to liquid crystal display pixels. The error voltage, which is incidentally produced for each drive output terminal, causes a difference in applied voltage between pixels of a liquid crystal display device, so that display unevenness occurs.

The third conventional technique (e.g., techniques described in Patent Literatures 1 and 2) is taken as an example of a technique for solving the problems of the first and second conventional techniques.

FIG. 23 shows a configuration example of a differential amplifier circuit in accordance with the third conventional technique. Note that FIG. 23 shows a case where N-channel MOS transistors are used as input transistors.

The reference numerals in FIG. 23 indicate respective members as below. The reference numerals 101 and 102 each indicate an N-channel MOS input transistor. The reference numeral 103 indicates a constant current source that supplies an operational electric current to the differential amplifier circuit. The reference numeral 104 indicates a load resistor (resistance element) of the input transistor 101. The reference numeral 105 indicates a load resistor (resistance element) of the input transistor 102. The reference numerals 106 and 107 each indicate a switch for switching an input signal. The reference numerals 108 and 109 each indicate a switch for switching an output signal. The reference numeral 110 indicates an in-phase input terminal. The reference numeral 111 indicates an antiphase input terminal. The reference numeral 112 indicates an in-phase output terminal. The reference numeral 113 indicates an antiphase output terminal. The reference numeral 114 indicates a switching signal input terminal via which a switching signal for simultaneously switching the switches 106 to 109 is inputted.

The input transistor 101, the load resistor 104, the input transistor 102, and the load resistor 105 constitute an amplifier circuit. The transistors 101 and 102 constitute a differential pair. The switches 106 to 109 are simultaneously controlled by the switching signal 114. Note that the in-phase input terminal 110 corresponds to a + input terminal of the operational amplifier 4601 illustrated in FIG. 21 and that the antiphase input terminal 111 corresponds to a – input terminal of the operational amplifier 4601 illustrated in FIG. 21.

FIG. 24 illustrates a state in which the differential amplifier circuit illustrated in FIG. 23 operates. FIG. 25 illustrates another state in which the differential amplifier circuit illustrated in FIG. 23 operates. The following description discusses, with reference to FIGS. 24 and 25, how the differential amplifier circuit operates.

In the state illustrated in FIG. 24, the in-phase input terminal 110 is connected to a gate of the input transistor 101 via the switch 106. An input signal inputted via the in-phase input terminal 110 is outputted, by a function of the load resistor 104 connected to a drain of the input transistor 101, via the antiphase output terminal 113 as an antiphase output signal after passing through the switch 109. Meanwhile, the antiphase input terminal 111 is connected to a gate of the input transistor 102 via the switch 107. An input signal inputted via the antiphase input terminal 111 is outputted, by a function of the load resistor 105 connected to a drain of the input transistor 102, via the in-phase output terminal 112 as an in-phase output signal after passing through the switch 108. That is, the in-phase input signal is amplified by the input transistor 101 and the load resistor 104, whereas the antiphase input signal is amplified by the input transistor 102 and the load resistor 105.

In contrast, in the state illustrated in FIG. 25, the in-phase input terminal 110 is connected to the gate of the input transistor 102 via the switch 107. An input signal inputted via the in-phase input terminal 110 is outputted, by a function of the load resistor 105 connected to the drain of the input transistor 102, via the antiphase output terminal 113 as an antiphase output signal after passing through the switch 109. Meanwhile, the antiphase input terminal 111 is connected to the gate of the input transistor 101 via the switch 106. An input signal inputted via the antiphase input terminal 111 is outputted, by a function of the load resistor 104 connected to the drain of the input transistor 101, via the in-phase output terminal 112 as an in-phase output signal after passing through the switch 108. That is, the in-phase input signal is amplified by the input transistor 102 and the load resistor 105, whereas the antiphase input signal is amplified by the input transistor 101 and the load resistor 104.

As described above, an amplifier circuit for the in-phase input signal and an amplifier circuit for the antiphase input signal are used by being completely replaced with each other in the states illustrated in FIGS. 24 and 25.

Note here that the following description discusses, with reference to FIGS. 26 and 27, a case where there exists a difference in characteristic, which difference incidentally occurs due to, for example, a manufacturing variation, between the input transistors 101 and 102 and/or between the load resistors 104 and 105, which constitute the differential amplifier circuit.

In a case where a difference occurs between two elements of the differential amplifier circuit which are supposed to have an identical characteristic, an output voltage is in a state deviating from an ideal state, so that the differential amplifier circuit has an offset voltage. Such deviation can be modeled assuming that one of the input terminals is connected to a constant voltage source. FIGS. 26 and 27 each illustrate a state of the modeling. The reference numeral 115 in each of FIGS. 26 and 27 indicates a constant voltage source which models the offset voltage of the differential amplifier circuit. Note that switching elements illustrated in FIG. 26 are identical in state to those illustrated in FIG. 24 and that switching elements illustrated in FIG. 27 are in identical in state to those illustrated in FIG. 25.

In FIG. 26, the constant voltage source 115 is connected to the antiphase input terminal 111 via the switch 107. Meanwhile, in FIG. 27, the constant voltage source 115 is connected to the in-phase input terminal 110 via the switch 107. With this configuration, since the differential amplifier circuit uses the switches 106 through 109, it is possible to change states in which offset voltages of the differential amplifier circuit which are incidentally produced due to a variation are inputted via the antiphase input terminal 111 and the in-phase input terminal 110, respectively. In these two states, the offset voltages across the in-phase output terminal 110 and the antiphase output terminal 111, respectively, are counter in sign and identical in absolute value to each other.

With the above configuration, even if an operational amplifier has an offset voltage which is incidentally produced due to, for example, a manufacturing variation, deviations from respective expectation voltages are equal to each other between a case where a positive-polarity offset voltage is outputted and a case where a negative-polarity offset voltage is outputted. Therefore, no component of a difference between the two deviations remains as an error voltage in an average voltage of driving voltages which are to be applied to liquid crystal display pixels. Accordingly, in a case where the above operational amplifier is used in a liquid crystal drive circuit, there occurs no difference in applied voltage between pixels of a liquid crystal display device, so that display unevenness can be prevented.

FIG. 28 shows a case of the differential amplifier circuit in which P-channel MOS transistors are used as the input transistors.

The reference numerals in FIG. 28 indicate respective members as below. The reference numerals 601 and 602 each indicate a P-channel MOS input transistor. The reference numeral 603 indicates a constant current source that supplies an operational electric current to the differential amplifier circuit. The reference numeral 604 indicates a load resistor (resistance element) of the input transistor 601. The reference numeral 605 indicates a load resistor (resistance element) of the input transistor 602. The reference numerals 606 and 607 each indicate a switch for switching an input signal. The reference numerals 608 and 609 each indicate a switch for switching an output signal. The reference numeral 610 indicates an in-phase input terminal. The reference numeral 611 indicates an antiphase input terminal. The reference numeral 612 indicates an in-phase output terminal. The reference numeral 613 indicates an antiphase output terminal. The reference numeral 614 indicates a switching signal input terminal via which a switching signal for simultaneously switching the switches 606 to 609 is inputted.

The input transistor 601, the load resistor 604, the input transistor 602, and the load resistor 605 constitute an amplifier circuit. The transistors 601 and 602 constitute a differential pair. The switches 606 to 609 are simultaneously controlled by the switching signal 614. Note that the in-phase input terminal 610 corresponds to a + input terminal of the operational amplifier 4602 illustrated in FIG. 21 and that the antiphase input terminal 611 corresponds to a – input terminal of the operational amplifier 4602 illustrated in FIG. 21.

FIG. 29 illustrates a state in which the differential amplifier circuit illustrated in FIG. 28 operates. FIG. 30 illustrates another state in which the differential amplifier circuit illustrated in FIG. 28 operates. The following description discusses, with reference to FIGS. 29 and 30, how the differential amplifier circuit operates.

In the state illustrated in FIG. 29, the in-phase input terminal 610 is connected to a gate of the input transistor 601 via the switch 606. An input signal inputted via the in-phase input terminal 610 is outputted, by a function of the load resistor 604 connected to a drain of the input transistor 601, via the antiphase output terminal 613 as an antiphase output signal after passing through the switch 609. Meanwhile, the antiphase input terminal 611 is connected to a gate of the input transistor 602 via the switch 607. An input signal inputted via the antiphase input terminal 611 is outputted, by a function of the load resistor 605 connected to a drain of the input transistor 602, via the in-phase output terminal 612 as an in-phase output signal after passing through the switch 608. That is, the in-phase input signal is amplified by the input transistor 601 and the load resistor 604, whereas the antiphase input signal is amplified by the input transistor 602 and the load resistor 605.

In contrast, in the state illustrated in FIG. 30, the in-phase input terminal 610 is connected to the gate of the input transistor 602 via the switch 607. An input signal inputted via the in-phase input terminal 610 is outputted, by a function of the load resistor 605 connected to the drain of the input transistor 602, via the antiphase output terminal 613 as an antiphase output signal after passing through the switch 609. Meanwhile, the antiphase input terminal 611 is connected to the gate of the input transistor 601 via the switch 606. An input signal inputted via the antiphase input terminal 611 is outputted, by a function of the load resistor 604 connected to the drain of the input transistor 601, via the in-phase output terminal 612 as an in-phase output signal after passing through the switch 608. That is, the in-phase input signal is amplified by the input transistor 602 and the load resistor 605, whereas the antiphase input signal is amplified by the input transistor 601 and the load resistor 604.

As described above, an amplifier circuit for the in-phase input signal and an amplifier circuit for the antiphase input signal are used by being completely replaced with each other in the states illustrated in FIGS. 29 and 30.

Note here that the following description discusses, with reference to FIGS. 31 and 32, a case where there exists a difference in characteristic, which difference incidentally occurs due to, for example, a manufacturing variation, between the input transistors 601 and 602 and/or between the load resistors 604 and 605, which constitute the differential amplifier circuit.

In a case where a difference occurs between two elements of the differential amplifier circuit which are supposed to have an identical characteristic, an output voltage is in a state deviating from an ideal state, so that the differential amplifier circuit has an offset voltage. Such deviation can be modeled assuming that one of the input terminals is connected to a constant voltage source. FIGS. 31 and 32 each illustrate a state of the modeling. The reference numeral 615 in each of FIGS. 31 and 32 indicates a constant voltage source which models the offset voltage of the differential amplifier circuit. Note that switching elements illustrated in FIG. 31 are identical in state to those illustrated in FIG. 29 and that switching elements illustrated in FIG. 32 are in identical in state to those illustrated in FIG. 30.

In FIG. 31, the constant voltage source 615 is connected to the antiphase input terminal 611 via the switch 607. Meanwhile, in FIG. 32, the constant voltage source 615 is connected to the in-phase input terminal 610 via the switch 607. With this configuration, since the differential amplifier circuit uses the switches 606 through 609, it is possible to change states in which offset voltages of the differential amplifier circuit which are incidentally produced due to a variation are inputted via the antiphase input terminal 611 and the in-phase input terminal 610, respectively. In these two states, the offset voltages across the in-phase output terminal 610 and the antiphase output terminal 611, respectively, are counter in sign and identical in absolute value to each other.

With this configuration, as is the case described earlier, deviations from respective expectation voltages are equal to each other between a case where a positive-polarity offset voltage is outputted and a case where a negative-polarity offset voltage is outputted. Accordingly, in a case where the above operational amplifier is used in a liquid crystal drive circuit, there occurs no difference in applied voltage between pixels of a liquid crystal display device, so that display unevenness can be prevented.

FIG. 33 illustrates a circuit configuration in which load elements of the differential amplifier circuit of FIG. 23 are replaced with active loads having a current mirror configuration. Note that FIG. 33 illustrates a case where N-channel MOS transistors are used as the input transistors.

The reference numerals in FIG. 33 indicate respective members as below. The reference numerals 1101 and 1102 each indicate an N-channel MOS input transistor. The reference numeral 1103 indicates a constant current source that supplies an operational electric current to the differential amplifier circuit. The reference numeral 1104 indicates a P-channel MOS load transistor which serves as a load on the input transistor 1101. The reference numeral 1105 indicates a P-channel MOS load transistor which serves as a load on the input transistor 1102. The reference numerals 1106 and 1107 each indicate a switch for switching an input signal. The reference numerals 1108 and 1109 each indicate a switch for switching an output signal. The reference numeral 1110 indicates an in-phase input terminal. The reference numeral 1111 indicates an antiphase input terminal. The reference numeral 1112 indicates an in-phase output terminal. The reference numeral 1113 indicates an antiphase output terminal. The reference numeral 1114 indicates a switching signal input terminal via which a switching signal for simultaneously switching the switches 1106 to 1109 is inputted.

The differential amplifier circuit is different from the configuration example (passive load) of FIG. 23 in that the load elements are the active loads having a current mirror configuration made up of transistors. In a state corresponding to that of FIG. 24, an in-phase input signal is amplified by each of the input transistor 1101 and the load transistor 1104, whereas an antiphase input signal is amplified by each of the input transistor 1102 and the load transistor 1105. In contrast, in a state corresponding to that of FIG. 25, an in-phase input signal is amplified by each of the input transistor 1102 and the load transistor 1105, whereas an antiphase input signal is amplified by each of the input transistor 1101 and the load transistor 1104.

In any of the cases, the load transistors 1104 and 1105 have a current mirror configuration. Therefore, even if there is a variation in characteristic between the load transistors, electric currents which flow in the respective load transistors 1104 and 1105 are constantly equal to each other. Therefore, the in-phase input signal and the antiphase input signal are amplified at an identical amplification degree, so that an output waveform in bilateral symmetry is obtained.

As described above, also according to the differential amplifier circuit having the structure illustrated in FIG. 33, an amplifier circuit for the in-phase input signal and an amplifier circuit for the antiphase input signal can be used by being completely replaced with each other.

Furthermore, also in a case where there exists a difference in characteristic, which difference incidentally occurs due to, for example, a manufacturing reason, between the input transistors 1101 and 1102 which constitute the differential amplifier circuit, the differential amplifier circuit of FIG. 33 is identical in structure to the differential amplifier circuit of FIG. 23 (not specifically described). Accordingly, since the differential amplifier circuit uses the switches 1106 through 1109, it is possible to change states in which offset voltages of the differential amplifier circuit which are incidentally produced due to a variation are inputted via the antiphase input terminal 1111 and the in-phase input terminal 1110, respectively. In these two states, the offset voltages across the in-phase output terminal 1110 and the antiphase output terminal 1111, respectively, are counter in sign and identical in absolute value to each other.

With this configuration, as is the case described earlier, deviations from respective expectation voltages are equal to each other between a case where a positive-polarity offset voltage is outputted and a case where a negative-polarity offset voltage is outputted. Accordingly, in a case where the above operational amplifier is used in a liquid crystal drive circuit, there occurs no difference in applied voltage between pixels of a liquid crystal display device, so that display unevenness can be prevented.

FIG. 34 illustrates a circuit configuration in which load elements of the differential amplifier circuit of FIG. 28 are replaced with active loads having a current mirror configuration. Note that FIG. 34 illustrates a case where P-channel MOS transistors are used as the input transistors.

The reference numerals in FIG. 34 indicate respective members as below. The reference numerals 1201 and 1202 each indicate a P-channel MOS input transistor. The reference numeral 1203 indicates a constant current source that supplies an operational electric current to the differential amplifier circuit. The reference numeral 1204 indicates an N-channel MOS load transistor which serves as a load on the input transistor 1201. The reference numeral 1205 indicates an N-channel MOS load transistor which serves as a load on the input transistor 1202. The reference numerals 1206 and 1207 each indicate a switch for switching an input signal. The reference numerals 1208 and 1209 each indicate a switch for switching an output signal. The reference numeral 1210 indicates an in-phase input terminal. The reference numeral 1211 indicates an antiphase input terminal. The reference numeral 1212 indicates an in-phase output terminal. The reference numeral 1213 indicates an antiphase output terminal. The reference numeral 1214 indicates a switching signal input terminal via which a switching signal for simultaneously switching the switches 1206 to 1209 is inputted.

The configuration of FIG. 34 is different from the configuration (passive load) of FIG. 28 in that the load elements are the active loads having a current mirror configuration made up of transistors. In a state corresponding to that of FIG. 29, an in-phase input signal is amplified by each of the input transistor 1201 and the load transistor 1204, whereas an antiphase input signal is amplified by each of the input transistor 1202 and the load resistor 1205. In contrast, in a state corresponding to that of FIG. 30, an in-phase input signal is amplified by each of the input transistor 1202 and the load transistor 1205, whereas an antiphase input signal is amplified by each of the input transistor 1201 and the load transistor 1204.

In any of the cases, the load transistors 1204 and 1205 have a current mirror configuration. Therefore, even if there is a variation in characteristic between the load transistors, electric currents which flow in the respective load transistors 1204 and 1205 are constantly equal to each other. Therefore, the in-phase input signal and the antiphase input signal are amplified at an identical amplification degree, so that an output waveform in bilateral symmetry is obtained.

As described above, also according to the differential amplifier circuit having the structure illustrated in FIG. 34, an amplifier circuit for the in-phase input signal and an amplifier circuit for the antiphase input signal are used by being completely replaced with each other.

Furthermore, also in a case where there exists a difference in characteristic, which difference incidentally occurs due to, for example, a manufacturing reason, between the input transistors 1201 and 1202 which constitute the differential amplifier circuit, the differential amplifier circuit of FIG. 34 is identical in structure to the differential amplifier circuit of FIG. 28 (not specifically described). Accordingly, since the differential amplifier circuit uses the switches 1206 through 1209, it is possible to change states in which offset voltages of the differential amplifier circuit which are incidentally produced due to a variation are inputted via the antiphase input terminal 1211 and the in-phase input terminal 1210, respectively. In these two states, the offset voltages across the in-phase output terminal 1210 and the antiphase output terminal 1211, respectively, are counter in sign and identical in absolute value to each other.

With this configuration, as is the case described earlier, deviations from respective expectation voltages are equal to each other between a case where a positive-polarity offset voltage is outputted and a case where a negative-polarity offset voltage is outputted. Accordingly, in a case where the above operational amplifier is used in a liquid crystal drive circuit, there occurs no difference in applied voltage between pixels of a liquid crystal display device, so that display unevenness can be prevented.

FIG. 35 shows a configuration example in which a differential amplifier circuit 1301 equivalent to the differential amplifier circuit illustrated in FIG. 33, switches, and an output section are embodied. Note that FIG. 35 corresponds to an N-channel MOS input operational amplifier.

The reference numerals in FIG. 35 indicate respective members as below. The reference numeral 1301 indicates the differential amplifier circuit illustrated in FIG. 33. The reference numeral 1302 indicates an in-phase input terminal. The reference numeral 1303 indicates an antiphase input terminal. The reference numerals 1304 and 1305 each indicate a switch switching signal input terminal. The reference numerals 1306 to 1309 each indicate a switch. The reference numerals 1310 to 1313 each indicate a switch. The reference numerals 1314 and 1315 each indicate an N-channel MOS input transistor. The reference numerals 1316 and 1317 each indicate a P-channel MOS load transistor which serves as an active load on an input transistor. The reference numeral 1318 indicates a P-channel MOS output transistor. The reference numeral 1319 indicates an N-channel MOS output transistor. The reference numeral 1320 indicates an output terminal. The reference numeral 1321 indicates a bias voltage input terminal for providing the operational amplifier with an operating point. Note here that a circuit in which the differential amplifier circuit 1301 is replaced with a differential amplifier circuit including the resistor loads of FIG. 23 carries out an operation identical to that described below. Accordingly, a detailed description of the operation is omitted here.

In FIG. 35, the reference numerals 1314 and 1315 each correspond to the switch switching signal input terminal 1114 illustrated in FIG. 33, and the terminals 1304 and 1305 receive signals whose polarities are reversed to each other. The following description discusses, with reference to FIGS. 36 and 37, operations in accordance with an input of the switch switching signal.

In FIG. 35, the input transistors 1314 and 1315 correspond to the input transistors 1101 and 1102, respectively, illustrated in FIG. 33, and the load transistors 1316 and 1317 correspond to the load transistors 1104 and 1105, respectively, illustrated in FIG. 33.

Furthermore, the reference numerals in FIG. 35 correspond to the respective members as below. The reference numerals 1307 and 1309 each correspond to the switch 1106 illustrated in FIG. 33. The reference numerals 1306 and 1308 each correspond to the switch 1107 illustrated in FIG. 33. The reference numerals 1310 and 1313 each correspond to the switch 1108 illustrated in FIG. 33. The reference numerals 1311 and 1312 each correspond to the switch 1109 illustrated in FIG. 33. A transistor 1322 corresponds to the constant current source 1103 illustrated in FIG. 33.

When the switching input signal 1304 receives an L level (low level), the switches 1306, 1307, 1310, and 1311 are turned on since these switches are P-channel MOS transistors (see FIG. 36). In this case, the switches 1308, 1309, 1312 and 1313 are turned off since the switch switching signal input terminal 1305 receives an H level (high level). An in-phase input signal 1302 is supplied to the input transistor 1315 via the switch 1306. An antiphase input signal 1303 is supplied to the input transistor 1314 via the switch 1307. Furthermore, a gate signal is supplied to each of the load transistors 1316 and 1317 via the switch 1310, and the gate signal is supplied to the output transistor 1318 via the switch 1311. In the case of FIG. 36, the in-phase input signal is amplified by a circuit constituted by the transistor 1315 and the load transistor 1317, and the antiphase input signal is amplified by a circuit constituted by the transistor 1314 and the load transistor 1316.

When the switch switching signal input terminal 1305 receives an L level, the switches 1308, 1309, 1312, and 1313 are turned on in FIG. 37. In this case, the switches 1306, 1307, 1310 and 1311 are turned off since the switch switching signal input terminal 1304 receives an H level. In this configuration, an in-phase input signal 1302 is supplied to the input transistor 1314 via the switch 1308. An antiphase input signal 1303 is supplied to the input transistor 1315 via the switch 1309. Furthermore, a gate signal is supplied to each of the load transistors 1316 and 1317 via the switch 1313, and the gate signal is supplied to the output transistor 1318 via the switch 1312. In the case of FIG. 37, the in-phase input signal is amplified by a circuit constituted by the input transistor 1314 and the load transistor 1316, and the antiphase input signal is amplified by a circuit constituted by the input transistor 1315 and the load transistor 1317.

As illustrated in FIGS. 36 and 37, according to the present differential amplifier circuit, it is possible to replace the amplifier circuit for the in-phase input signal and the amplifier circuit for the antiphase input signal with each other by switching the switches 1306 to 1313. According to this, also in a case where offset voltages are incidentally produced in the differential amplifier circuit due to, for example, a manufacturing variation in characteristic, the offset voltages are counter in sign and identical in absolute value to each other in these two states (described earlier). Accordingly, in a case where the switches 1306 to 1313 are switched, offset voltages which vary in the operational amplifier can be counter in sign and identical in absolute value to each other, so that the offset voltages can be canceled. Note that a dotted line in each of FIGS. 36 and 37 indicates a signal flow.

FIG. 38 shows a configuration example in which a differential amplifier circuit 1601 equivalent to the differential amplifier circuit illustrated in FIG. 34, switches, and an output section are embodied. Note that FIG. 38 is a P-channel MOS input operational amplifier.

The reference numerals in FIG. 38 indicate respective members as below. The reference numeral 1602 indicates an in-phase input terminal. The reference numeral 1603 indicates an antiphase input terminal. The reference numerals 1604 and 1605 each indicate a switch switching signal input terminal. The reference numerals 1606 to 1609 each indicate a switch. The reference numerals 1610 to 1613 each indicate a switch. The reference numerals 1614 and 1615 each indicate a P-channel MOS input transistor. The reference numerals 1616 and 1617 each indicate an N-channel MOS load transistor which serves as an active load on an input transistor. The reference numeral 1618 indicates an N-channel MOS output transistor. The reference numeral 1619 indicates a P-channel MOS output transistor. The reference numeral 1620 indicates an output terminal. The reference numeral 1621 indicates a bias voltage input terminal for providing the operational amplifier with an operating point. Note here that a circuit in which the differential amplifier circuit 1601 is replaced with a differential amplifier circuit including the resistor loads described in FIG. 28 carries out an operation identical to that described below. Accordingly, a detailed description of the operation is omitted here.

The reference numerals in FIG. 38 correspond to the respective members as below. The input transistors 1614 and 1615 correspond to the input transistors 1201 and 1202, respectively, illustrated in FIG. 34, and the load transistors 1616 and 1617 correspond to the load transistors 1204 and 1205, respectively, illustrated in FIG. 34. Furthermore, the reference numerals 1607 and 1609 each correspond to the switch 1206 illustrated in FIG. 34. The reference numerals 1606 and 1608 each correspond to the switch 1207 illustrated in FIG. 34. The reference numerals 1610 and 1613 each correspond to the switch 1208 illustrated in FIG. 34. The reference numerals 1611 and 1612 each correspond to the switch 1209 illustrated in FIG. 34. A transistor 1622 corresponds to the constant current source 1203 illustrated in FIG. 34.

When the switch switching signal input terminal 1604 receives an H level (high level), the switches 1606, 1607, 1610, and 1611 are turned on since these switches are N-channel MOS transistors (see FIG. 39). In this case, the switches 1608, 1609, 1612 and 1613 are turned off since the switch switching signal input terminal 1605 receives an L level (low level). An in-phase input signal 1602 is supplied to the input transistor 1615 via the switch 1606. An antiphase input signal 1603 is supplied to the input transistor 1614 via the switch 1607. Furthermore, a gate signal is supplied to each of the load transistors 1616 and 1617 via the switch 1610, and the gate signal is supplied to the output transistor 1618 via the switch 1611. In the case of FIG. 39, the in-phase input signal is amplified by a circuit constituted by the input transistor 1615 and the load transistor 1617, and the antiphase input signal is amplified by a circuit constituted by the input transistor 1614 and the load transistor 1616.

When the switch switching signal input terminal 1605 receives an H level, the switches 1608, 1609, 1612, and 1613 are turned on in FIG. 40. In this case, the switches 1606, 1607, 1610 and 1611 are turned off since the switch switching signal input terminal 1604 receives an L level. In this configuration, an in-phase input signal 1602 is supplied to the input transistor 1614 via the switch 1608. An antiphase input signal 1603 is supplied to the input transistor 1615 via the switch 1609. Furthermore, a gate signal is supplied to each of the load transistors 1616 and 1617 via the switch 1613, and the gate signal is supplied to the output transistor 1618 via the switch 1612. In the case of FIG. 40, the in-phase input signal is amplified by a circuit constituted by the input transistor 1614 and the load transistor 1616, and the antiphase input signal is amplified by a circuit constituted by the input transistor 1615 and the load transistor 1617.

As illustrated in FIGS. 39 and 40, according to the present differential amplifier circuit, it is possible to replace the amplifier circuit for the in-phase input signal and the amplifier circuit for the antiphase input signal with each other by switching the switches 1606 to 1613. According to this, also in a case where offset voltages are incidentally produced in the differential amplifier circuit due to, for example, a manufacturing variation, the offset voltages are counter in sign and identical in absolute value to each other in these two states (described earlier). Accordingly, in a case where the switches 1606 to 1613 are switched, offset voltages which vary in the operational amplifier can be counter in sign and identical in absolute value to each other, so that the offset voltages can be canceled. Note that a dotted line in each of FIGS. 39 and 40 indicates a signal flow.

As described above, according to the third conventional technique, a positive-polarity voltage is supplied from the operational amplifier which uses an N-channel MOS transistor in its input stage, a negative-polarity voltage is supplied from the operational amplifier which uses a P-channel MOS transistor in its input stage, and the positive-polarity and negative-polarity voltages are full-range outputted by being switched by the switching switch. Furthermore, according to the third conventional technique, in a case where the in-phase input signal or the antiphase input signal is switched and supplied as an input signal to a corresponding input terminal (a corresponding one of the in-phase input terminal and antiphase input terminal) of the operational amplifier, in addition to the positive-polarity and negative-polarity voltages described above, new positive-polarity and negative-polarity voltages (obtained by reversing the positive-polarity and negative-polarity voltages described above) are generated by the switching of the input signal. This makes it possible to cancel the deviations A and −A, and B and −B in four frames by switching the deviations in the frames, the deviations A and −A each being caused by the offset voltage produced in the operational amplifier which uses an N-channel MOS transistor, and the deviations B and −B each being caused by the offset voltage produced in the operational amplifier which uses a P-channel MOS transistor (see FIG. 41). The third conventional technique thus makes it possible to prevent display unevenness.

CITATION LIST

Patent Literature

Patent Literature 1

Japanese Patent Application Publication, Tokukai, No. 2002-108303 A (Publication Date: Apr. 10, 2002)

Patent Literature 2

Japanese Patent Application Publication, Tokukaihei, No. 11-305735 A (1999) (Publication Date: Nov. 5, 1995)

SUMMARY OF INVENTION

Technical Problem

However, according to the conventional techniques, a large offset voltage may cause a deterioration in display quality due to a flicker occurring in an entire display screen.

The present invention has been made in view of the above problems, and an object of the present invention is to provide a display drive circuit, a display device, and a display drive method each of which is capable of enhancing a display quality while preventing a flicker from occurring in an entire display screen.

Solution to Problem

In order to attain the object, a display drive circuit of the present invention includes: a first amplifier circuit and a second amplifier circuit each amplifying either one of two input signals that are in-phase and antiphase; a switching circuit which selectively switches the two input signals in accordance with a switching signal and supplies the two input signals thus switched to the first amplifier circuit and the second amplifier circuit, respectively; and a switching control circuit which controls switching of the switching circuit by supplying the switching signal to the switching circuit, the switching control circuit supplying the switching signal to the switching circuit, the switching signal having a higher frequency than a horizontal synchronization signal.

According to the configuration, the switching circuit switches the input signals that are in-phase and antiphase in accordance with the switching signal having a higher frequency than the horizontal synchronization signal.

This makes it possible to shorten a cycle in which an intrinsic offset voltage (e.g., +A or −A) of an operational amplifier is switched (a frequency of an offset switching signal), so that a voltage level added to a source voltage level which is actually applied to a pixel electrode can be made smaller than a predetermined voltage level (+A or −A) (see FIG. 11). Therefore, this configuration allows a voltage which is actually applied to a pixel electrode to approach an expectation voltage. This makes it possible to prevent a flicker from occurring in the entire display screen.

In order to attain the object, a method for driving a display drive circuit of the present invention, the display drive circuit includes: a first amplifier circuit and a second amplifier circuit each amplifying either one of two input signals that are in-phase and antiphase; a switching circuit which selectively switches the two input signals in accordance with a switching signal and supplies the two input signals thus switched to the first amplifier circuit and the second amplifier circuit, respectively; and a switching control circuit which controls switching of the switching circuit by supplying the switching signal to the switching circuit, said method includes: causing the switching control circuit to supply the switching signal to the switching circuit, the switching signal having a higher frequency than a horizontal synchronization signal.

According to the configuration, it is possible to prevent a flicker from occurring in the entire display screen.

Advantageous Effects of Invention

As described above, according to the display drive circuit, the display device, and the display drive method of the present invention, the switching control circuit is configured to supply the switching signal to the switching circuit, the switching signal having a higher frequency than a horizontal synchronization signal. This makes it possible to enhance a display quality while preventing a flicker from occurring in an entire display screen.

(a) and (b) of FIG. 14 shows, in the switching control circuit in Modification 1 of the present invention, (i) a polarity state in each of the first and second frames, (ii) an electric potential level of a switching control signal, and (iii) an offset state.

Figure 15:
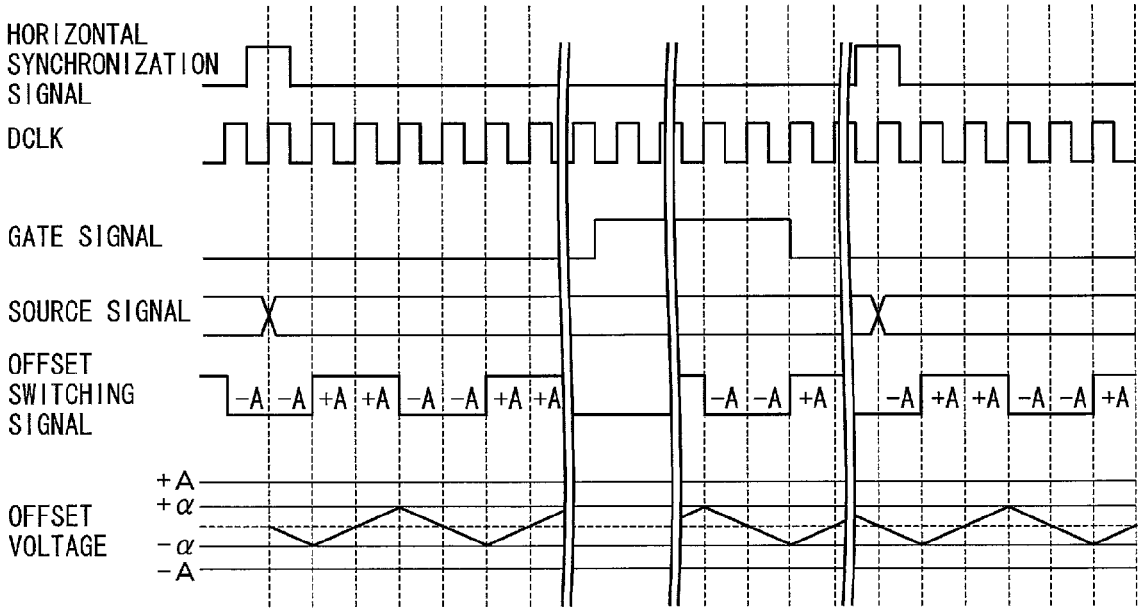

FIG. 15 is a timing chart corresponding to the third and fourth lines, which shows an input signal waveform and an output signal waveform of the switching control circuit and the operational amplifier in the liquid crystal display device of Modification 1.

(a) and (b) of FIG. 16 shows, in the switching control circuit in Modification 2 of the present invention, (i) a polarity state in each of the first and second frames, (ii) an electric potential level of a switching control signal, and (iii) an offset state.

(a) and (b) of FIG. 17 shows, in the switching control circuit in Modification 3 of the present invention, (i) a polarity state in each of the first and second frames, (ii) an electric potential level of a switching control signal, and (iii) an offset state.

Figure 18:
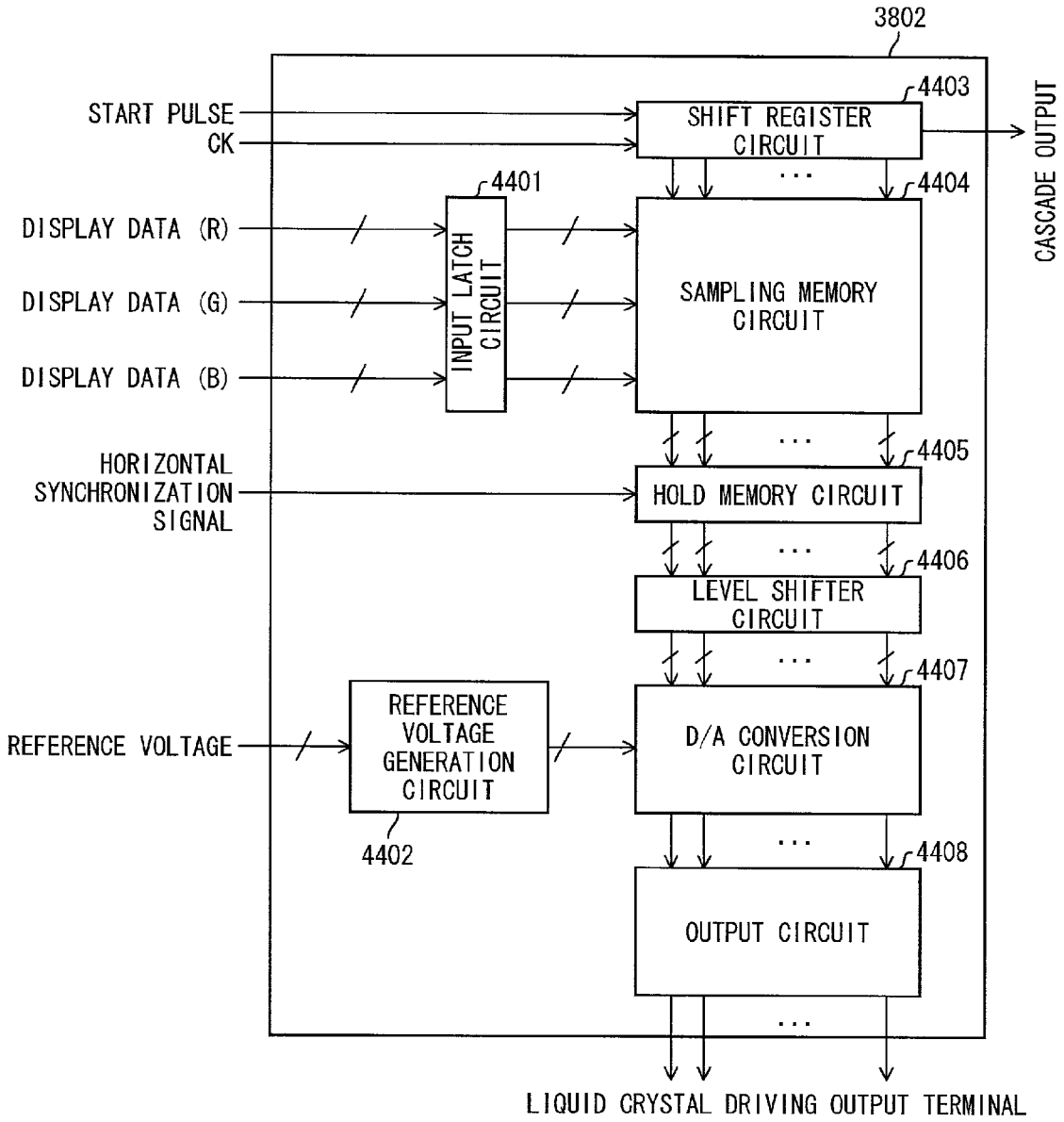
FIG. 18 PRIOR ART

FIG. 18 is a block diagram illustrating a configuration of a source driver in accordance with a conventional liquid crystal display device.

Figure 19:
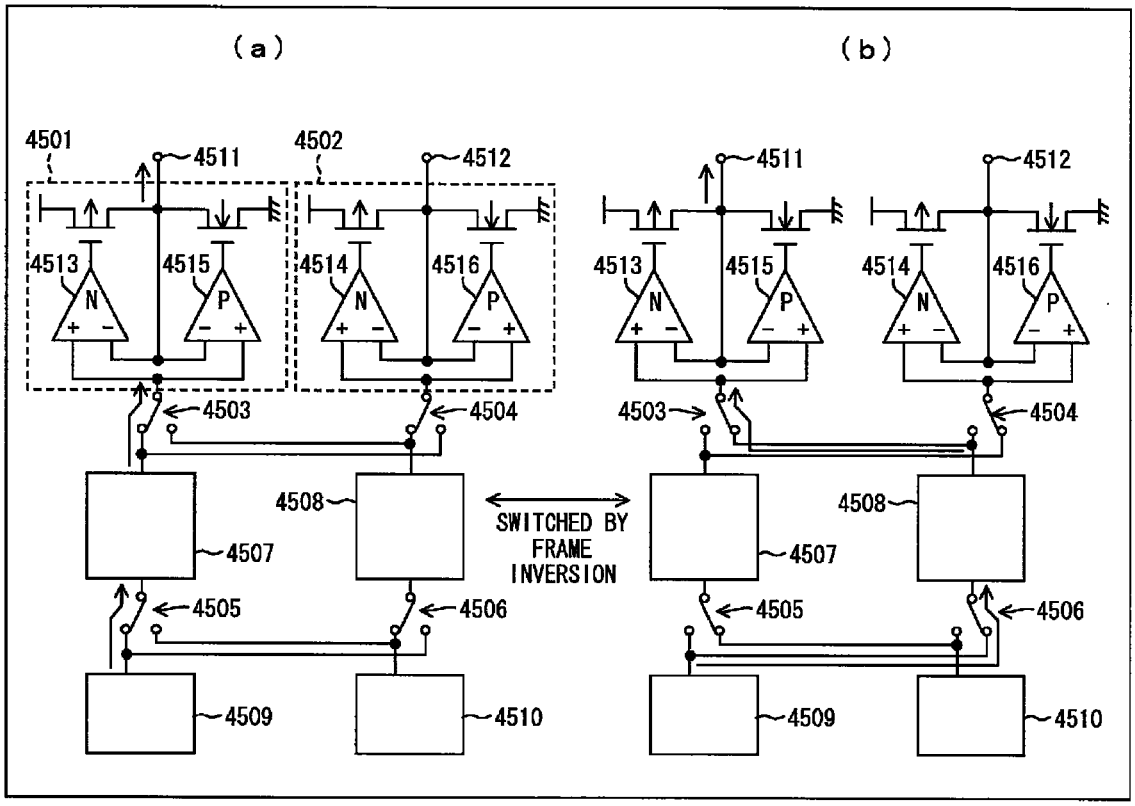
FIG. 19 PRIOR ART

(a) and (b) of FIG. 19 are block diagrams each illustrating an output circuit of a source driver IC in accordance with the first conventional technique, and also illustrating an example of an operation thereof.

Figure 20:
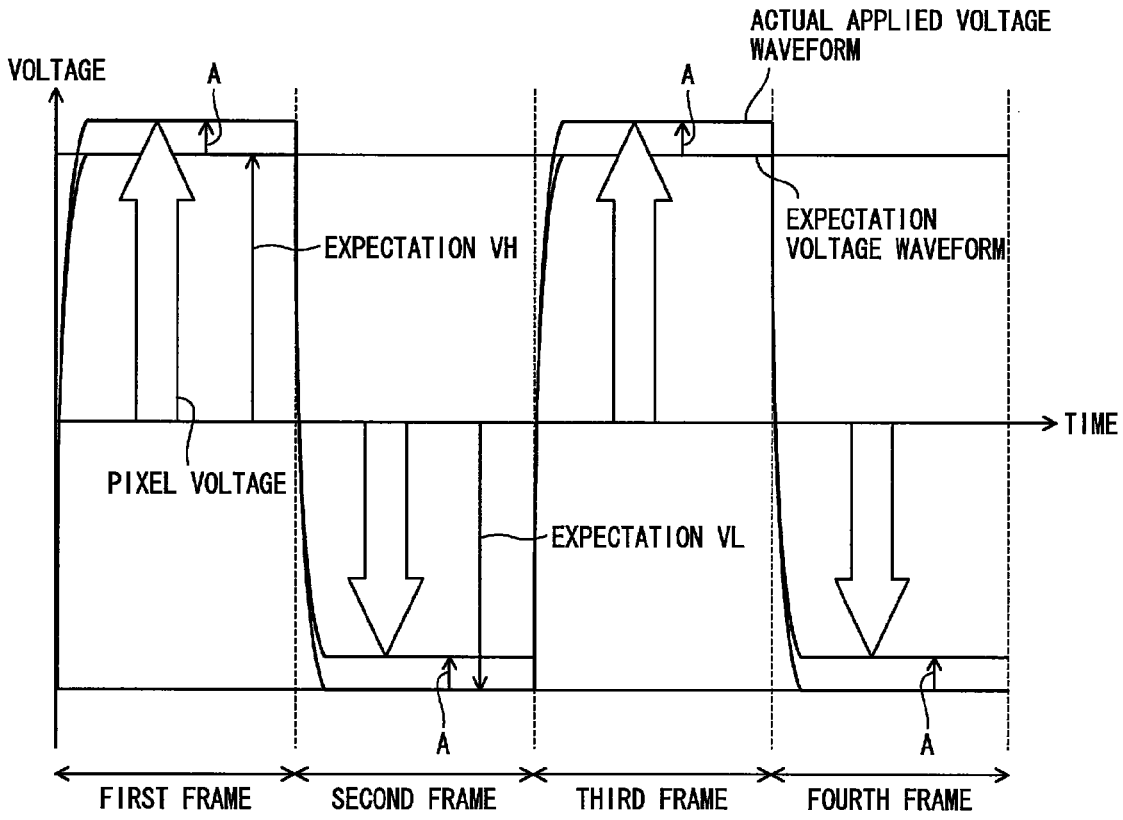
FIG. 20 PRIOR ART

FIG. 20 is a waveform chart showing a liquid crystal driving voltage waveform obtained in the configuration illustrated in FIG. 19.

Figure 21:
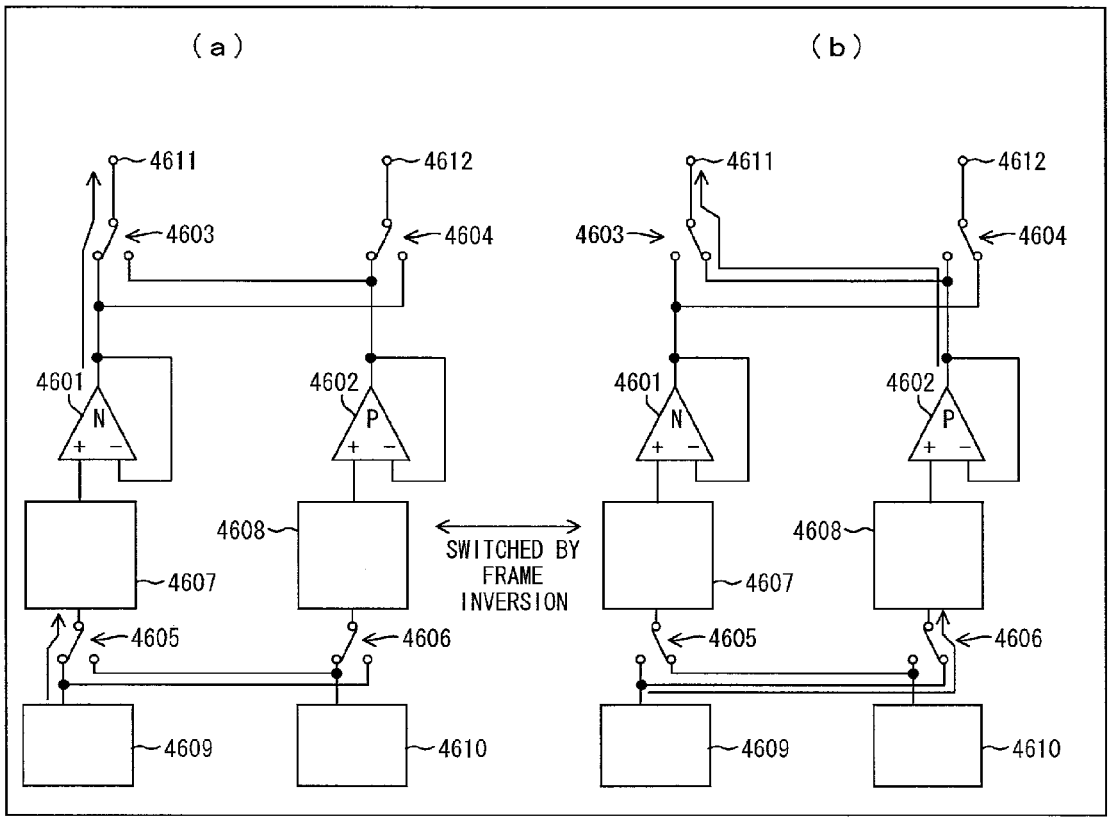
FIG. 21 PRIOR ART

(a) and (b) of FIG. 21 are block diagrams each illustrating an output circuit of a source driver IC in accordance with the second conventional technique, and also illustrating an example of an operation thereof.

Figure 22:
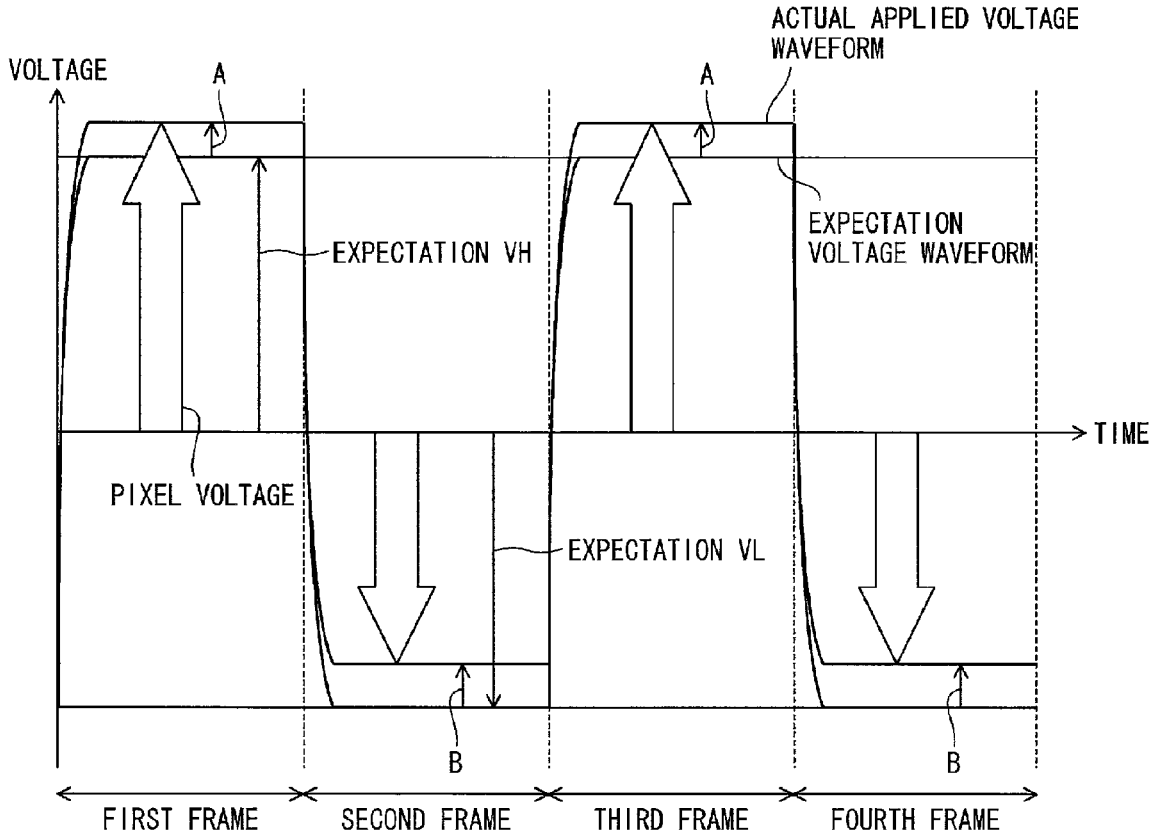
FIG. 22 PRIOR ART

FIG. 22 is a waveform chart showing a liquid crystal driving voltage waveform obtained in the configuration illustrated in FIG. 21.

Figure 23:
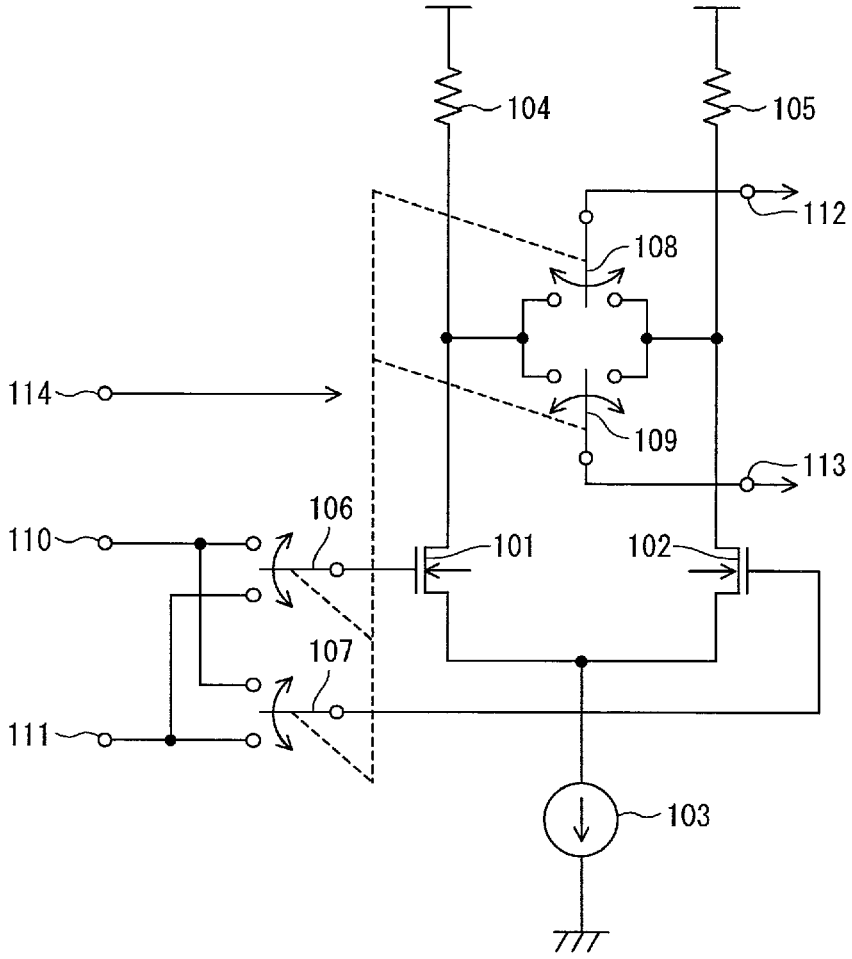
FIG. 23 PRIOR ART

FIG. 23 is a circuit diagram illustrating a differential amplifier circuit in accordance with the third conventional technique.

Figure 24:
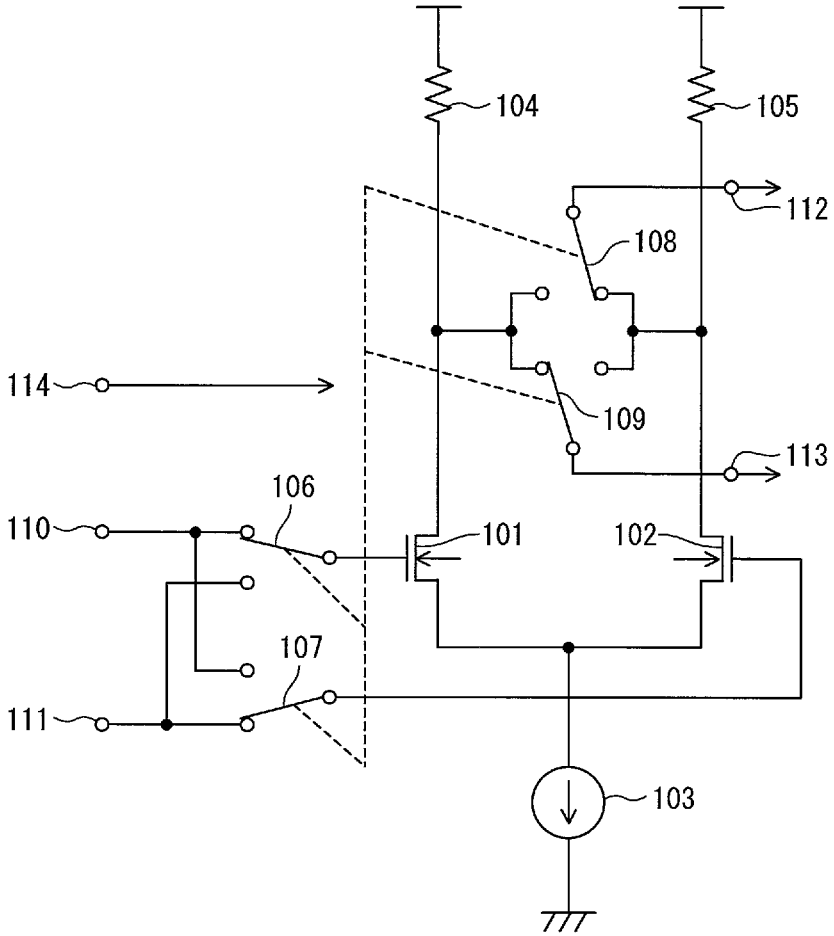
FIG. 24 PRIOR ART

FIG. 24 illustrates a state in which the differential amplifier circuit illustrated in FIG. 23 operates.

Figure 25:
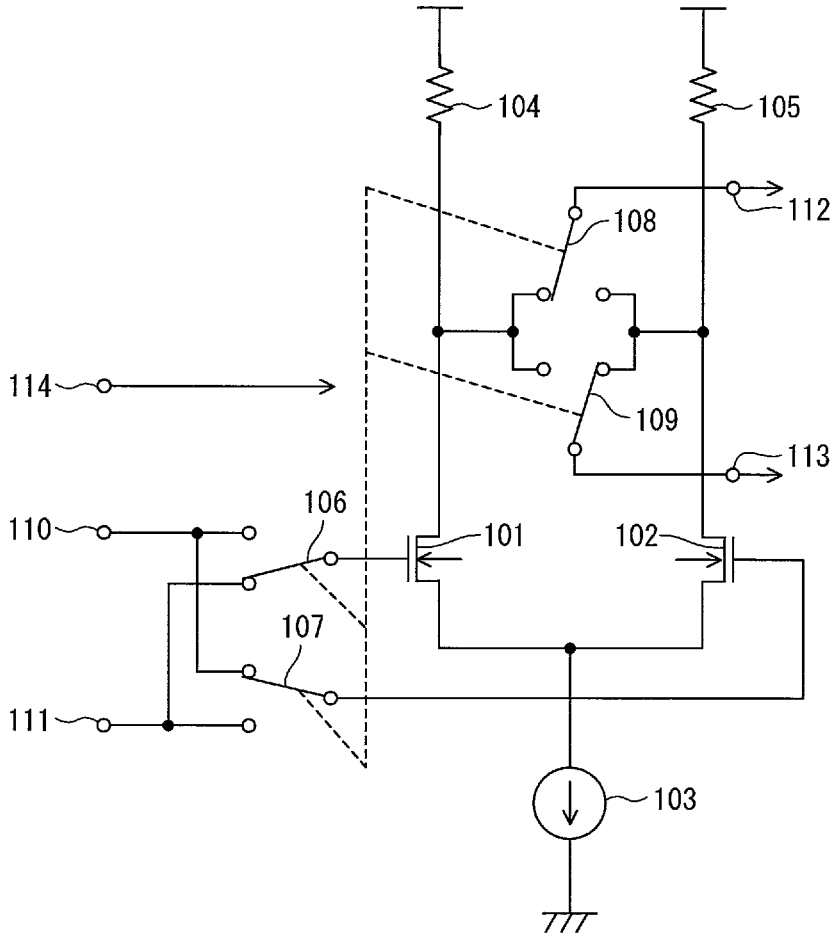
FIG. 25 PRIOR ART

FIG. 25 illustrates another state in which the differential amplifier circuit illustrated in FIG. 23 operates.

Figure 26:
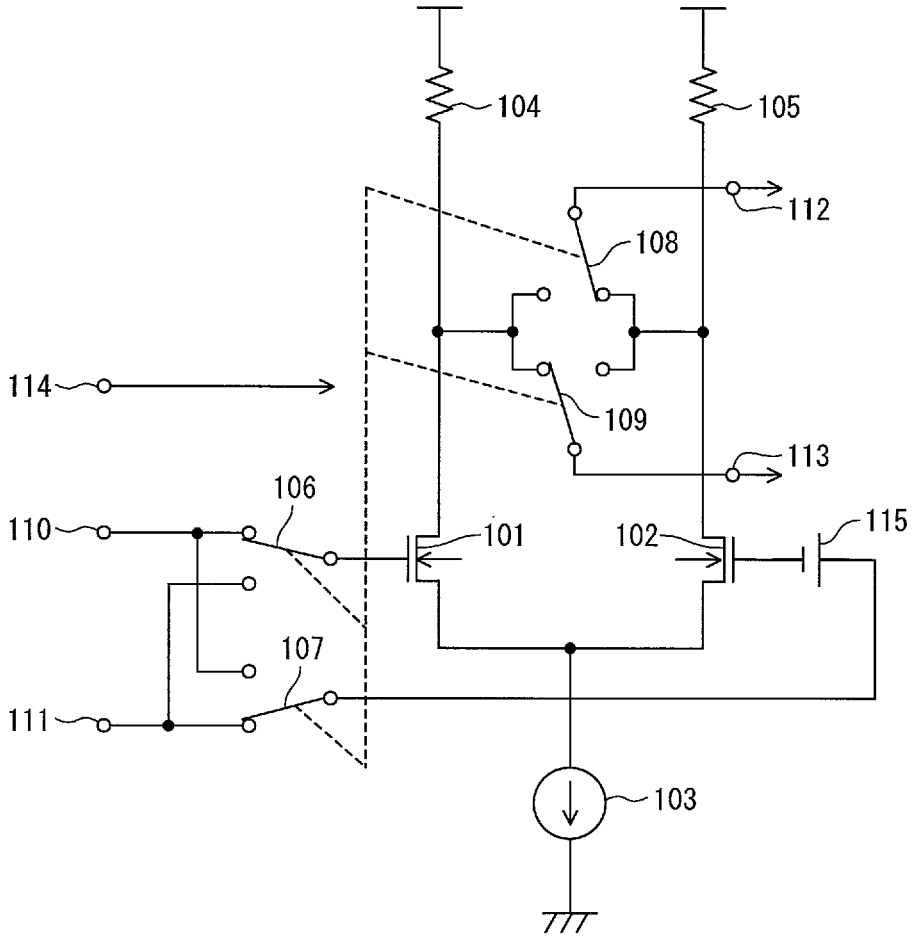
FIG. 26 PRIOR ART

FIG. 26 is an explanatory diagram showing a case where there exists a difference in characteristic, which difference incidentally occurs due to, for example, a manufacturing variation in an operational state illustrated in FIG. 24.

Figure 27:
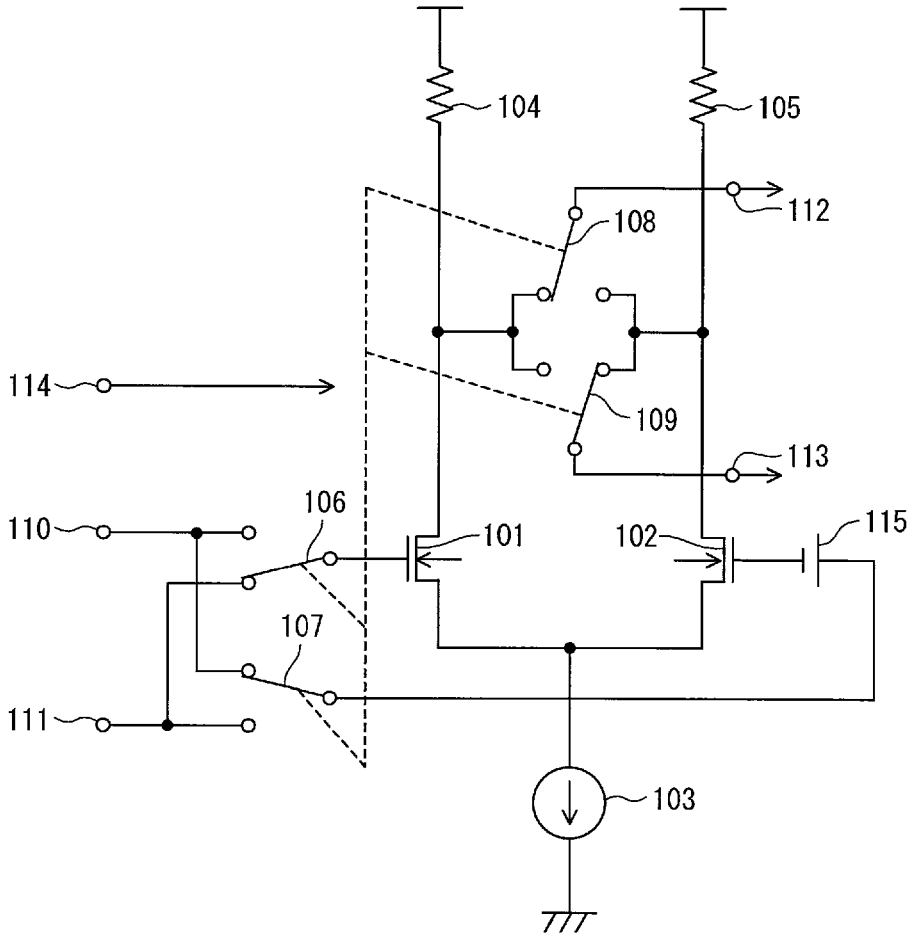
FIG. 27 PRIOR ART

FIG. 27 is an explanatory diagram showing a case where there exists a difference in characteristic, which difference incidentally occurs due to, for example, a manufacturing variation in an operational state illustrated in FIG. 25.

Figure 28:
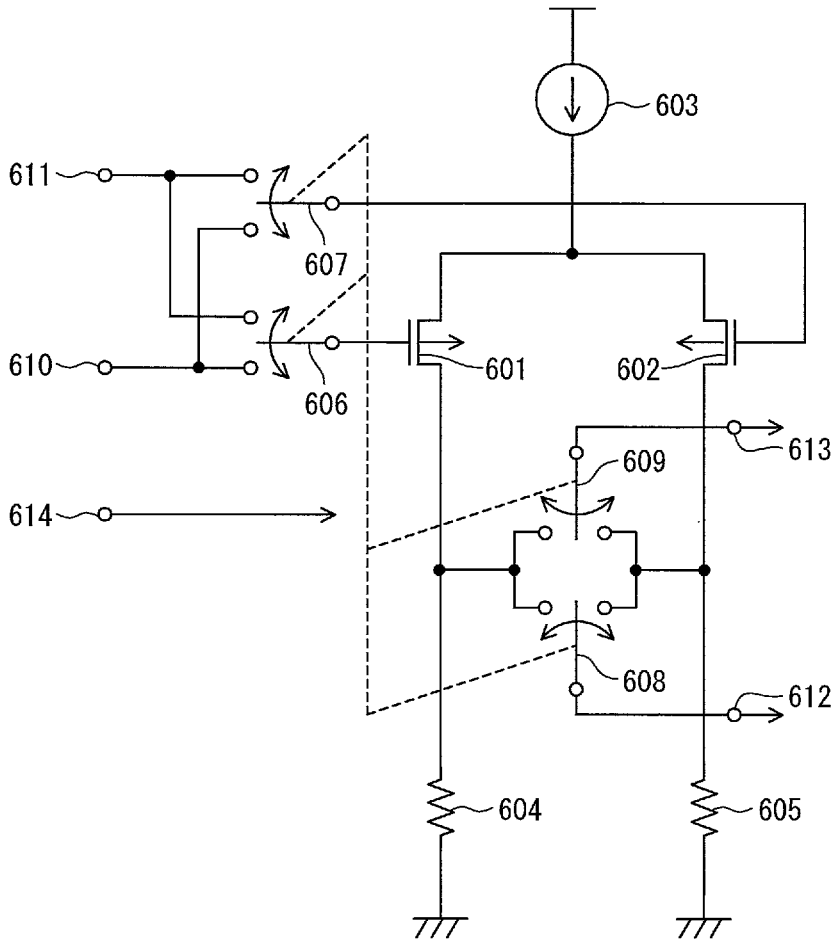
FIG. 28 PRIOR ART

FIG. 28 is a circuit diagram illustrating another differential amplifier circuit in accordance with the third conventional technique.

Figure 29:
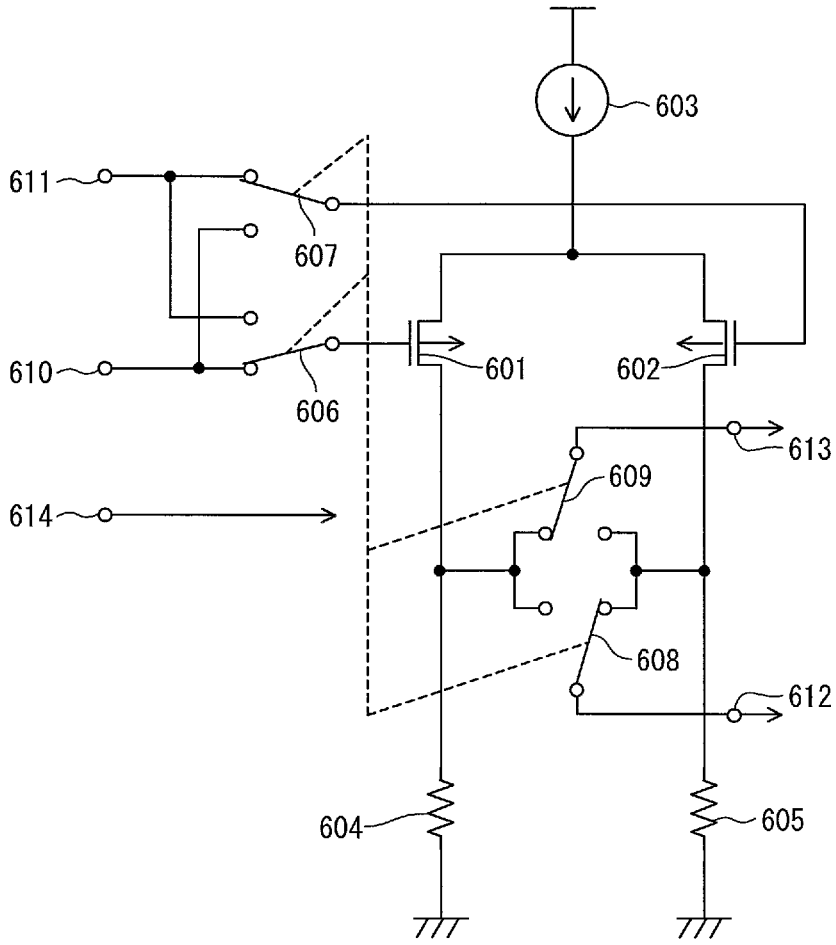
FIG. 29 PRIOR ART

FIG. 29 is an explanatory diagram illustrating an operation of the differential amplifier circuit of FIG. 28.

Figure 30:
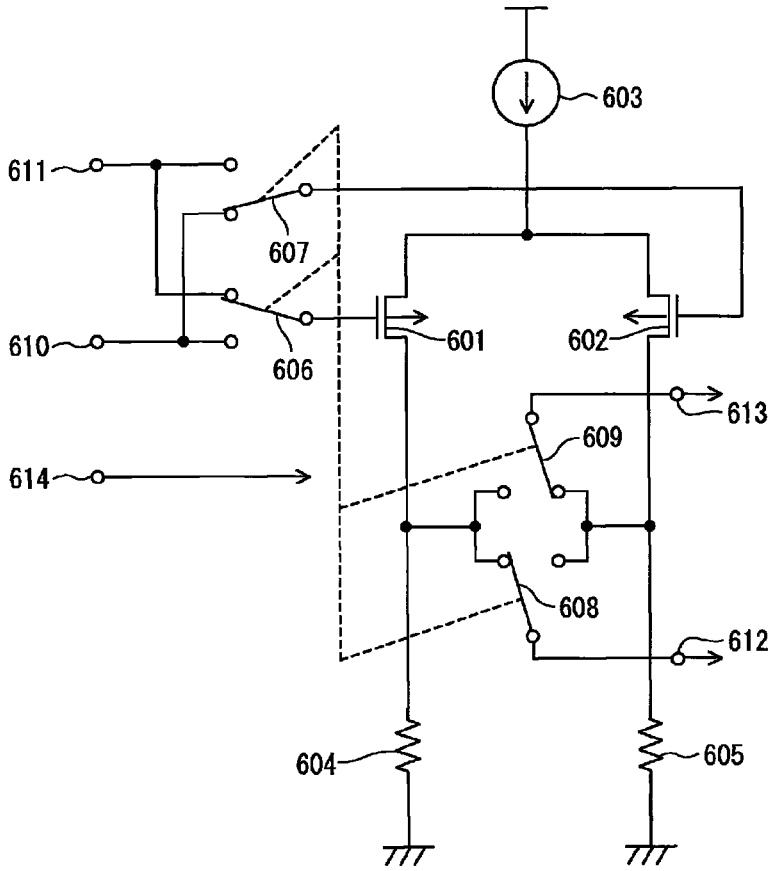
FIG. 30 PRIOR ART

FIG. 30 is an explanatory diagram illustrating another operation of the differential amplifier circuit of FIG. 28.

Figure 31:
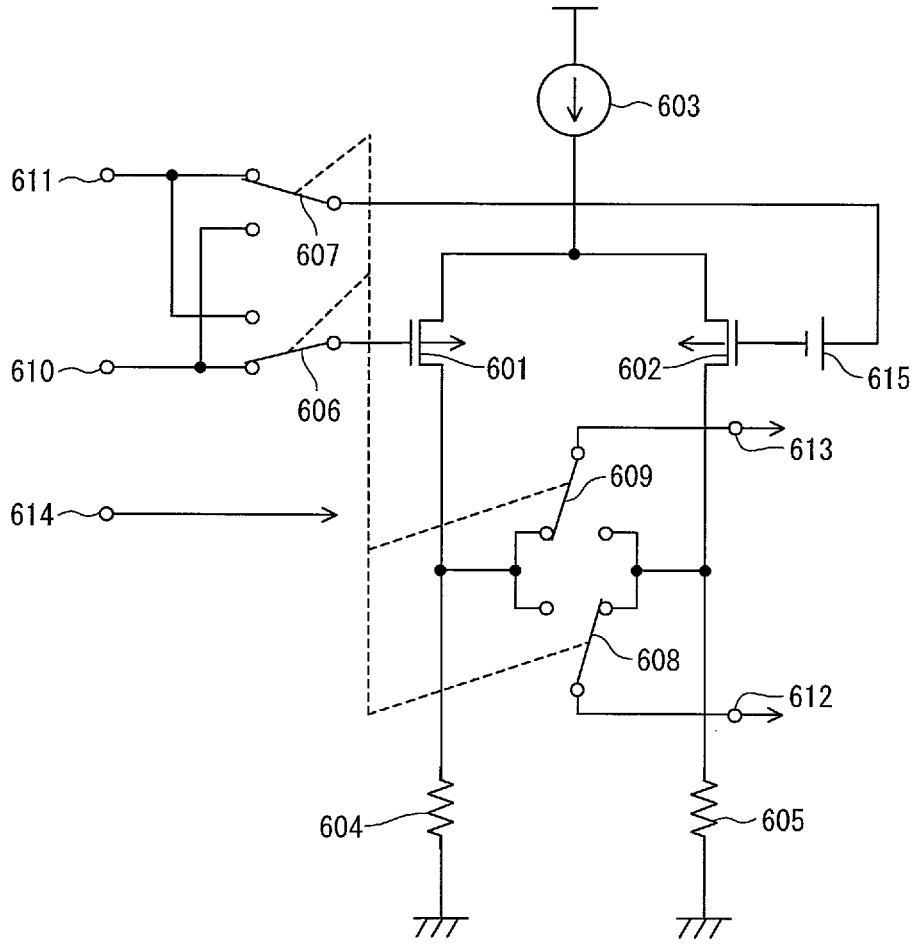
FIG. 31 PRIOR ART

FIG. 31 is an explanatory diagram showing a case where there exists a difference in characteristic, which difference incidentally occurs due to, for example, a manufacturing reason in an operational state illustrated in FIG. 29.

Figure 32:
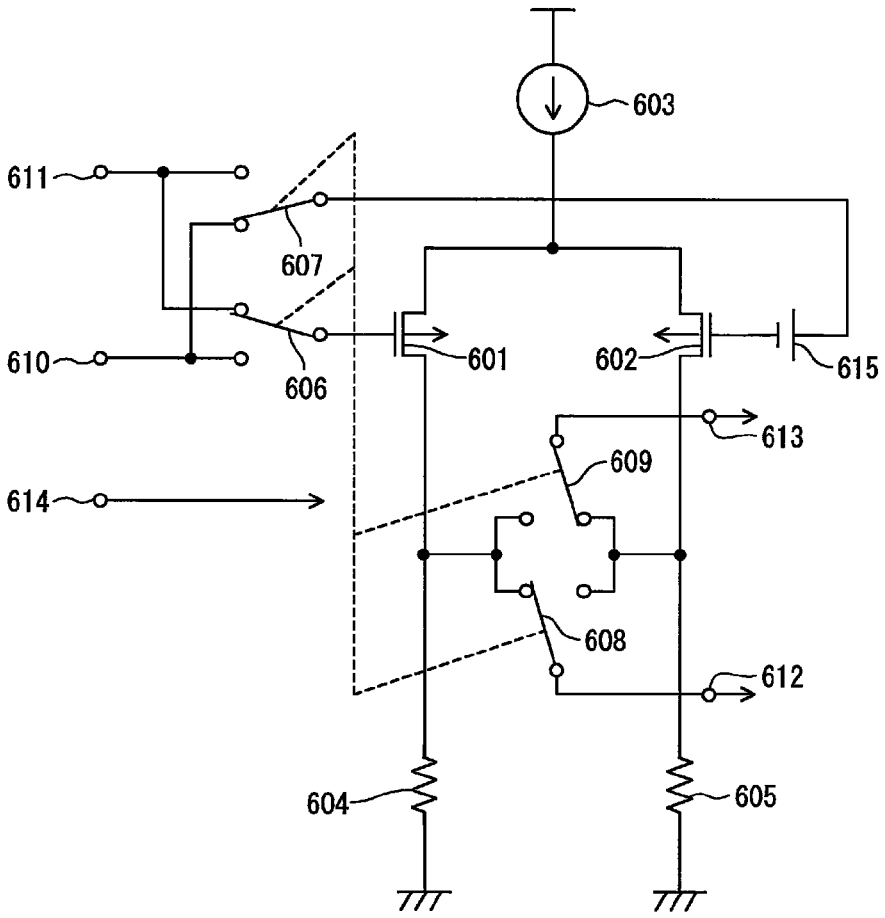
FIG. 32 PRIOR ART

FIG. 32 is an explanatory diagram showing a case where there exists a difference in characteristic, which difference incidentally occurs due to, for example, a manufacturing reason in an operational state illustrated in FIG. 30.

Figure 33:
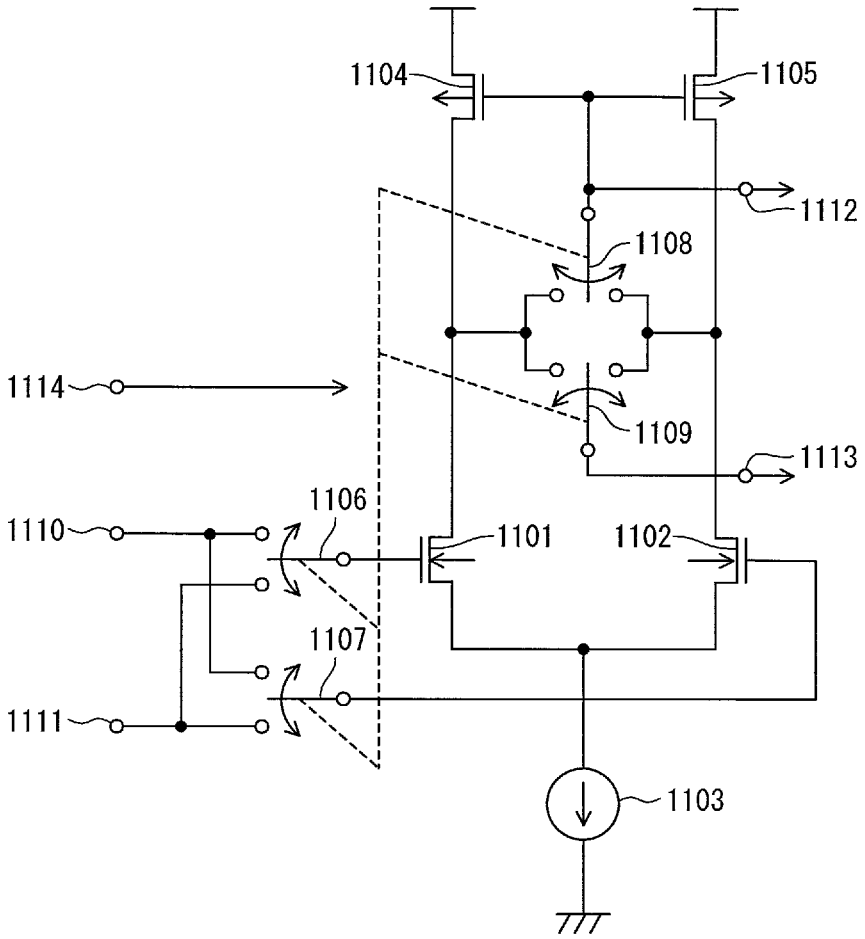
FIG. 33 PRIOR ART

FIG. 33 is a circuit diagram illustrating a circuit configuration in which load elements of the differential amplifier circuit of FIG. 23 are replaced with active loads having a current mirror configuration.

Figure 34:
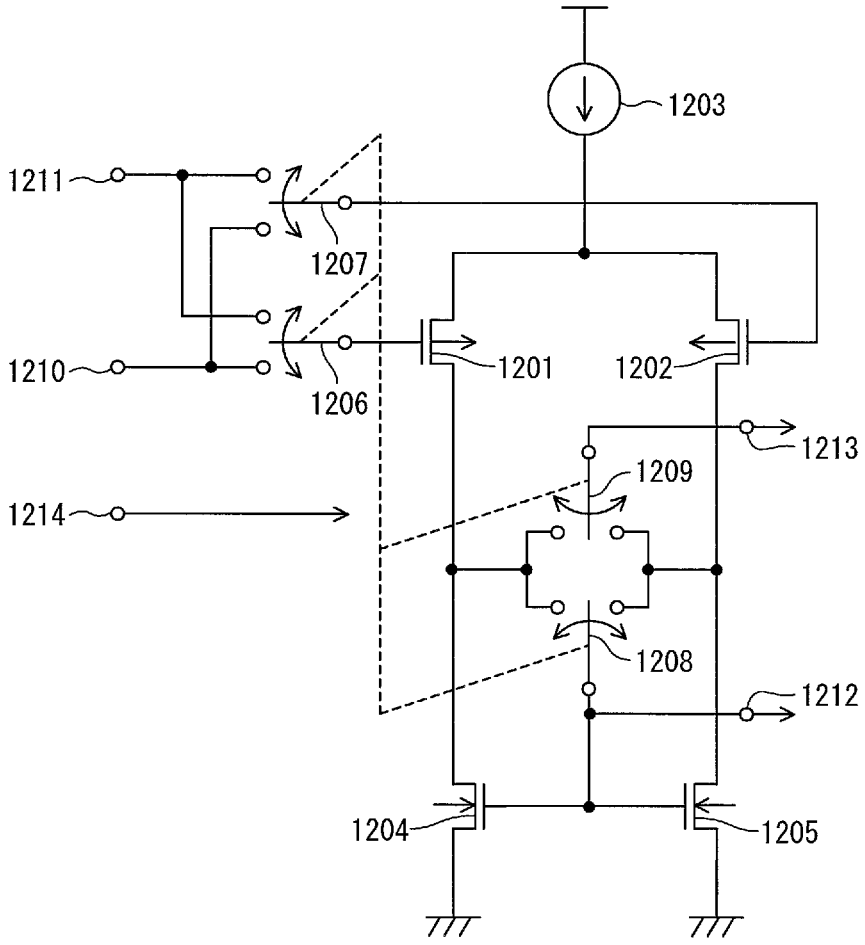
FIG. 34 PRIOR ART

FIG. 34 is a circuit diagram illustrating a circuit configuration in which load elements of the differential amplifier circuit of FIG. 28 are replaced with active loads having a current mirror configuration.

Figure 35:
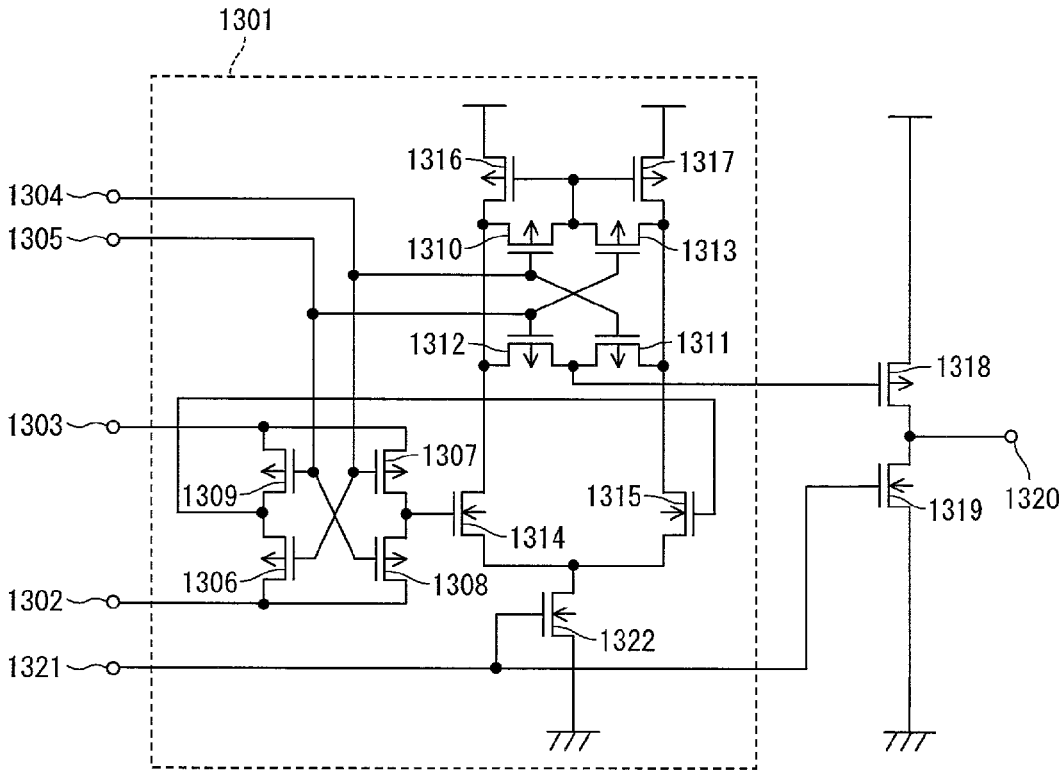
FIG. 35 PRIOR ART

FIG. 35 is a circuit diagram illustrating an example in which a differential amplifier circuit equivalent to the differential amplifier circuit illustrated in FIG. 33, switches, and an output section are embodied.

Figure 36:
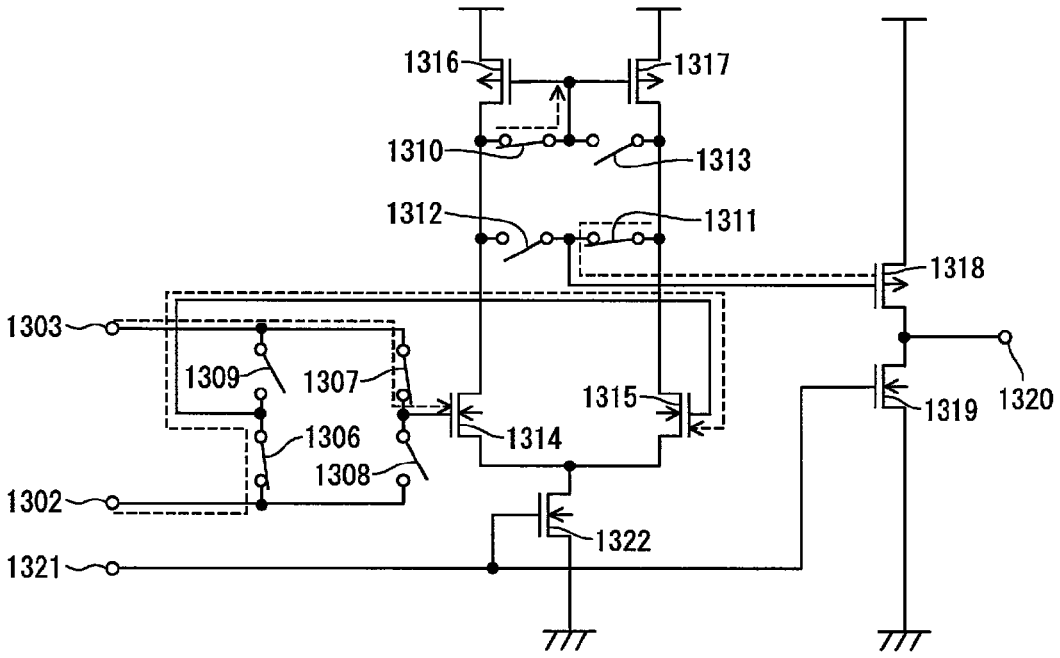
FIG. 36 PRIOR ART

FIG. 36 is a circuit diagram illustrating an operation of an operational amplifier of FIG. 35.

Figure 37:
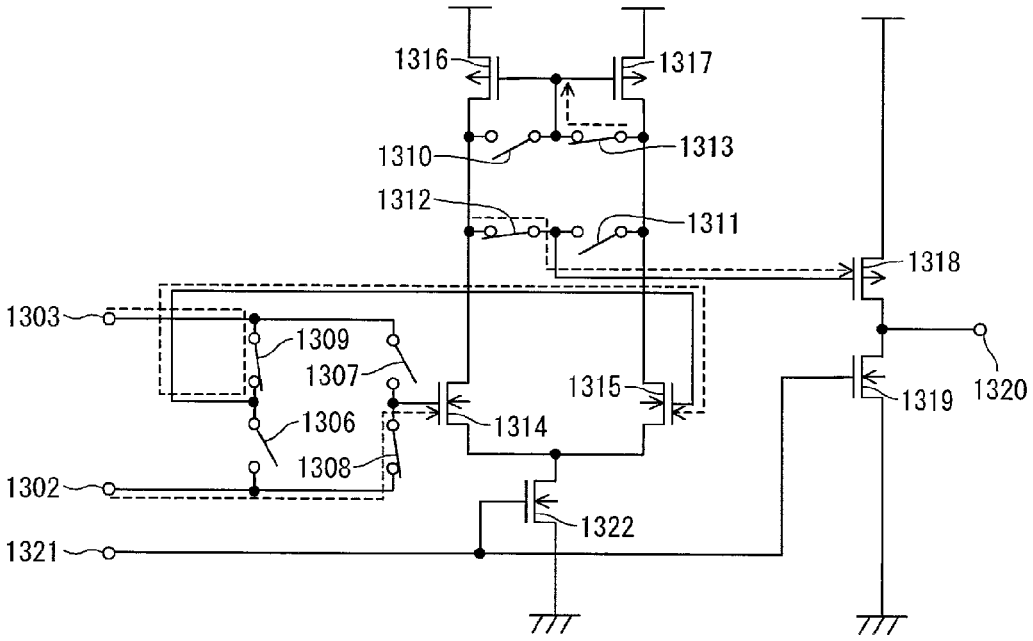
FIG. 37 PRIOR ART

FIG. 37 is a circuit diagram illustrating another operation of the operational amplifier of FIG. 35.

Figure 38:
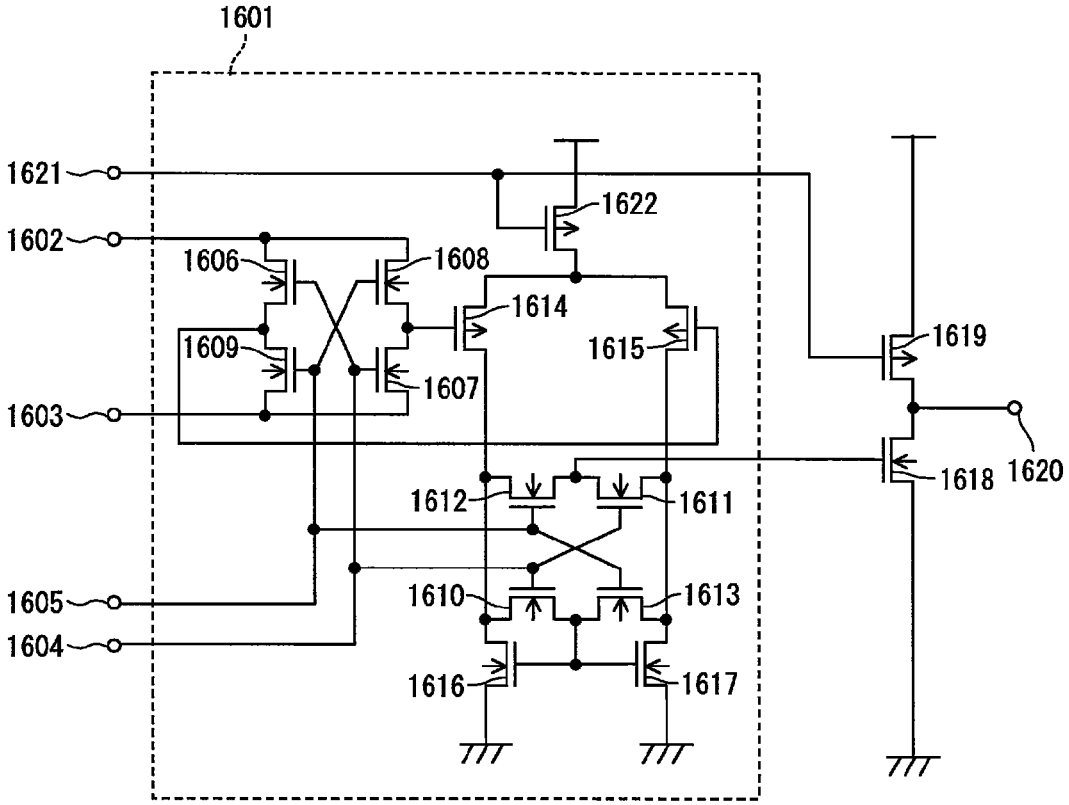
FIG. 38 PRIOR ART

FIG. 38 is a circuit diagram illustrating an example in which a differential amplifier circuit equivalent to the differential amplifier circuit illustrated in FIG. 34, switches, and an output section are embodied.

Figure 39:
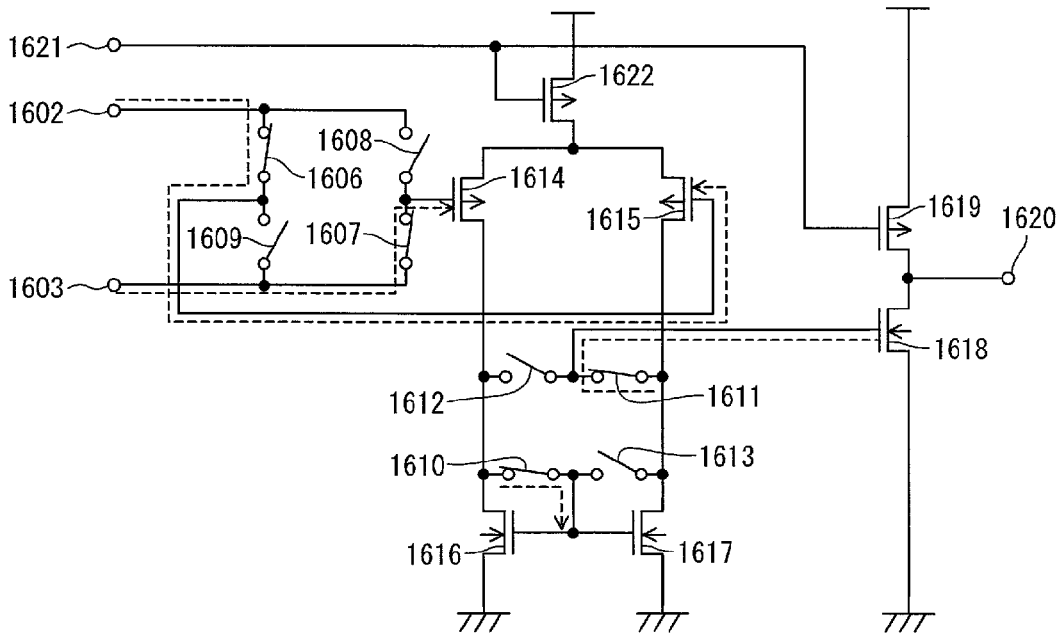
FIG. 39 PRIOR ART

FIG. 39 is a circuit diagram illustrating an operation of an operational amplifier of FIG. 38.

Figure 40:
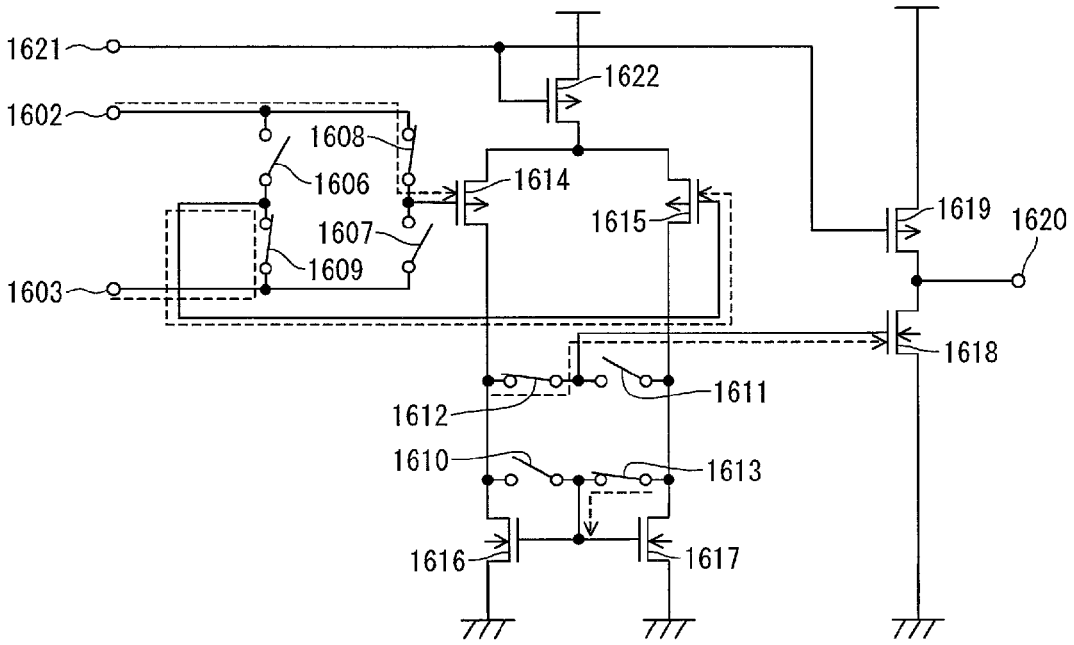
FIG. 40 PRIOR ART

FIG. 40 is a circuit diagram illustrating another operation of the operational amplifier of FIG. 38.

Figure 41:
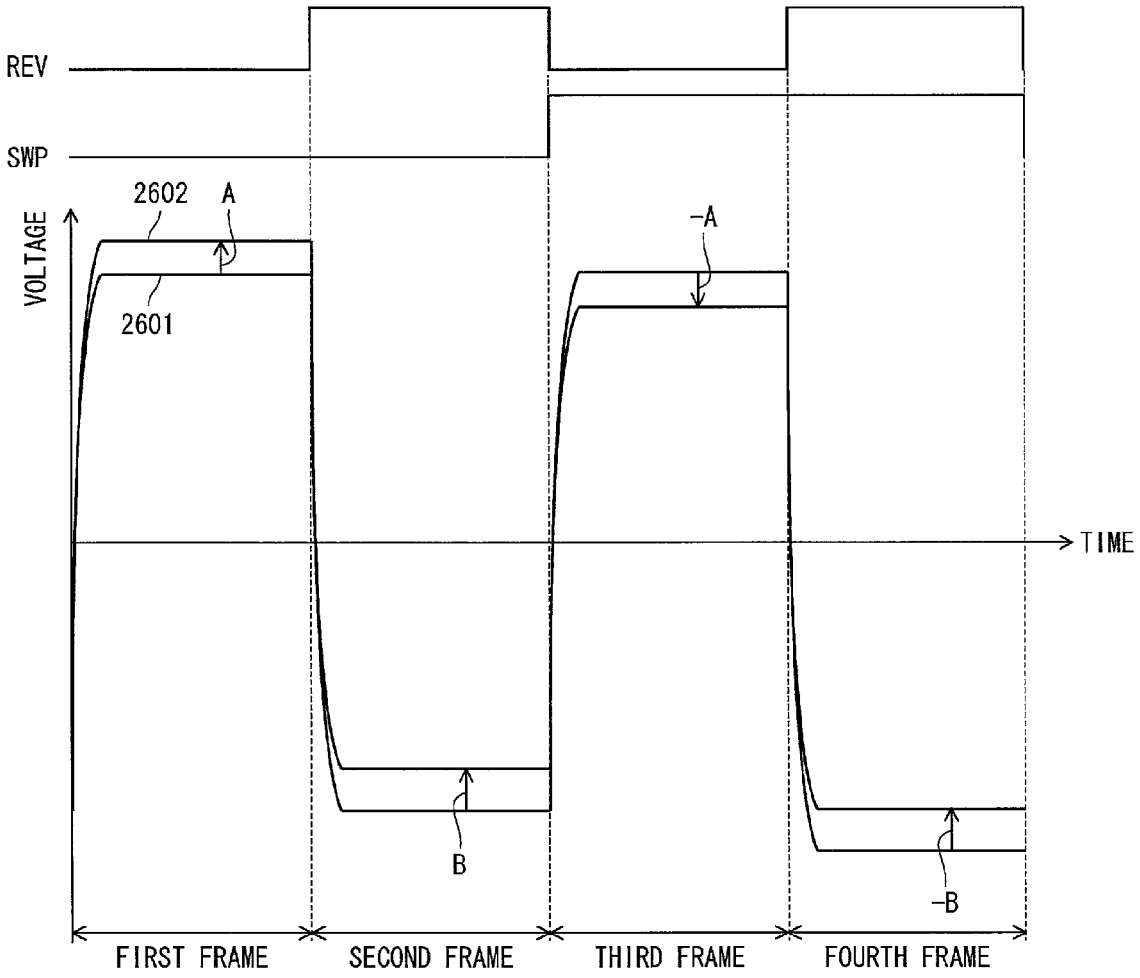
FIG. 41 PRIOR ART

FIG. 41 is a waveform chart showing a conventional relationship between (a) each of an alternation switch switching signal REV and a switch switching signal SWP of an operational amplifier and (b) an output.

DESCRIPTION OF EMBODIMENTS

Figure 1:
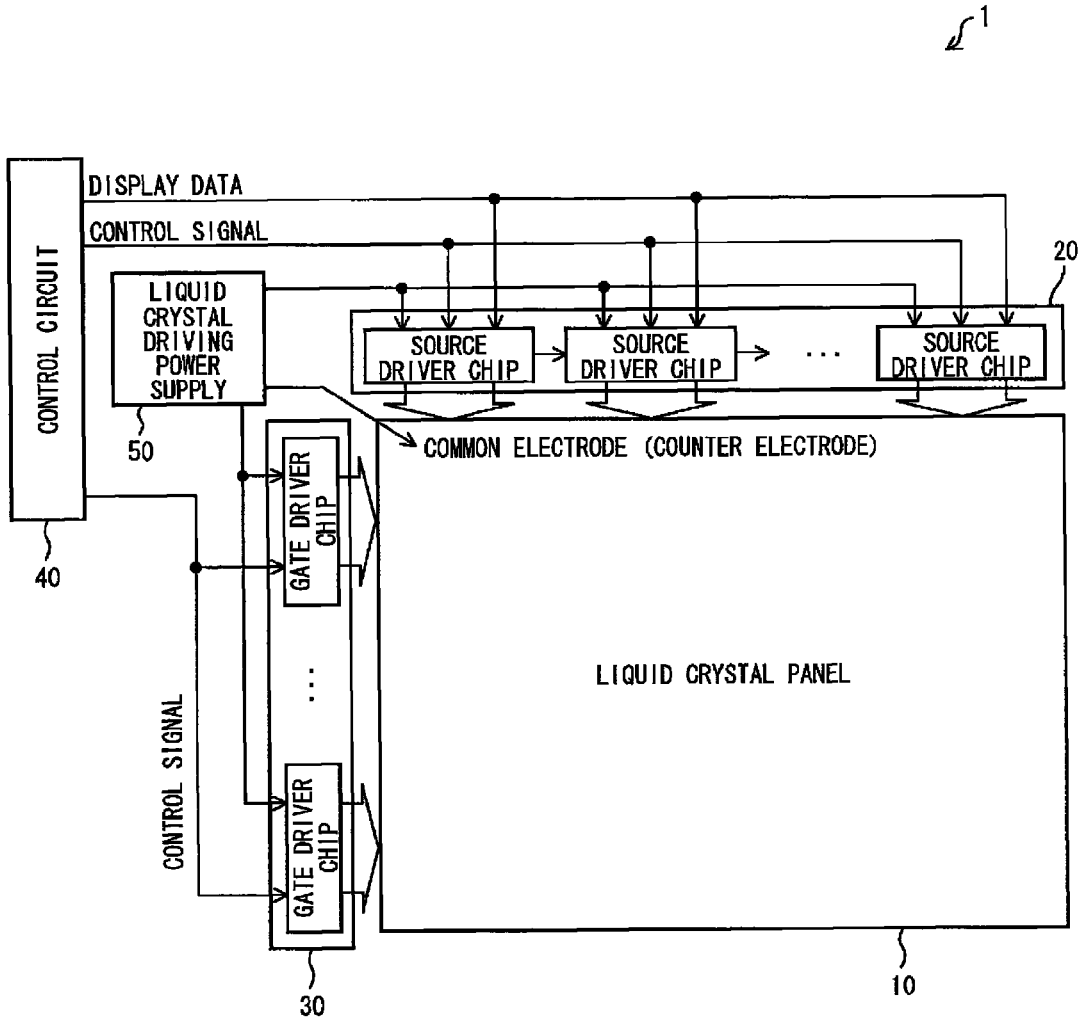
FIG. 1 is a block diagram schematically illustrating a configuration of a liquid crystal display device in accordance with the present invention.

FIG. 1 is a block diagram of a liquid crystal display device (display device) which uses a TFT in accordance with the present invention and serves as a typical example of an active matrix liquid crystal display device. A liquid crystal display device 1 includes a liquid crystal panel 10, a source driver 20 (display drive circuit) including a plurality of source driver chips, a gate driver 30 including a plurality of gate driver chips, a control circuit 40, and a liquid crystal driving power supply (power supply circuit) 50. Note that the number of source driver chips to be provided in the source driver and the number of gate driver chips to be provided in the gate driver do not need to be plural but may be one. Furthermore, it is not always necessary that each of the source driver 20 and the gate driver 30 be configured by driver chips. Alternatively, each of the source driver 20 and the gate driver 30 may be provided in a liquid crystal panel monolithically.

The control circuit 40 not only sends a vertical synchronization signal to the gate driver 30 but also sends a horizontal synchronization signal to each of the source driver 20 and the gate driver 30. Display data supplied from outside (here, respective pieces of display data separated into R, G, and B) are supplied as digital signals via the control circuit 40 to the source driver 20. The source driver 20 latches the supplied display data thereinto in a time division mode. Then, the source driver 20 outputs, via a liquid crystal driving output terminal, an analog voltage for a tone display by carrying out digital/analog conversion in sync with the horizontal synchronization signal from the control circuit 40.

Figure 2:
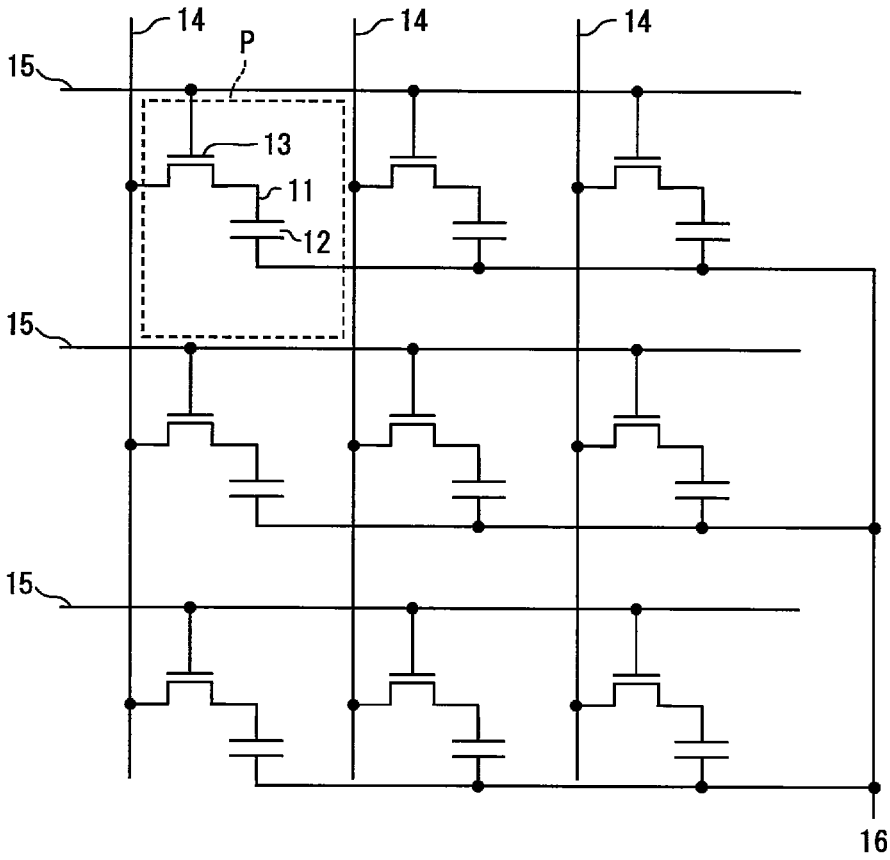
FIG. 2 is a plan view schematically illustrating a configuration of a liquid crystal panel in the liquid crystal display device of FIG. 1.

FIG. 2 schematically illustrates a configuration of the liquid crystal panel 10. A pixel electrode 11, a pixel capacitor 12, a TFT (switching element) 13, a source line 14, a gate line 15, and a counter electrode 16 are provided so as to correspond to each pixel P.

The source driver 20 supplies, to the source line 14, a tone display voltage (source voltage) which changes in accordance with a brightness of a display pixel. The gate driver 30 supplies, to the gate line 15, a scanning signal (gate signal) so that TFTs 13 provided in a column direction are sequentially turned on. When the TFT 13 is turned on, a voltage supplied to the source line 14 is applied to the pixel electrode 11 that is connected to a drain of the TFT 13, so that the voltage is accumulated in the pixel capacitor 12 provided between the pixel electrode 11 and the counter electrode 16. This causes a change in light transmittance of a liquid crystal, so that a display is carried out in accordance with the change.

Figure 3:
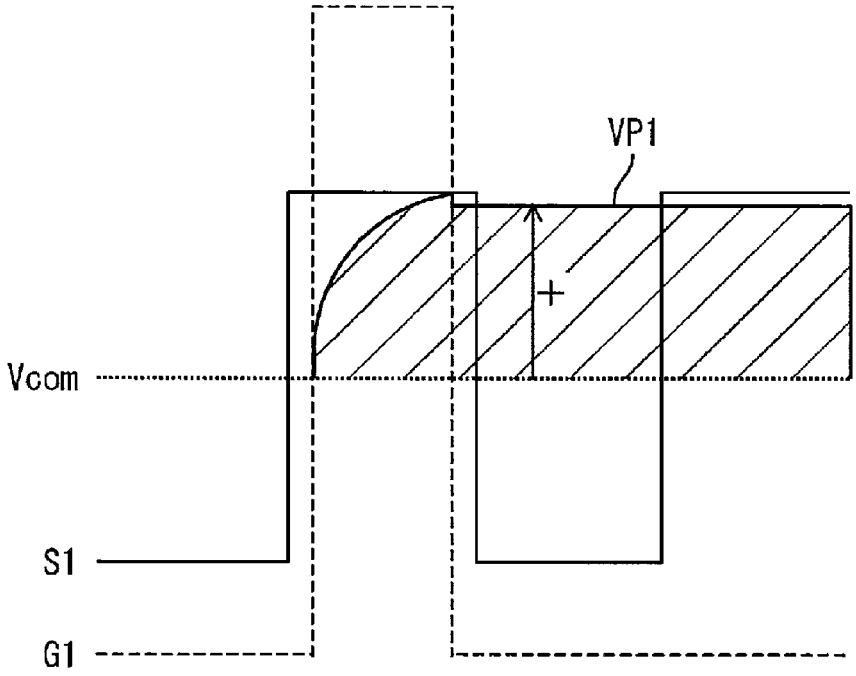
FIG. 3 is a waveform chart showing an example of a liquid crystal driving waveform obtained in the liquid crystal display device of FIG. 1.
Figure 4:
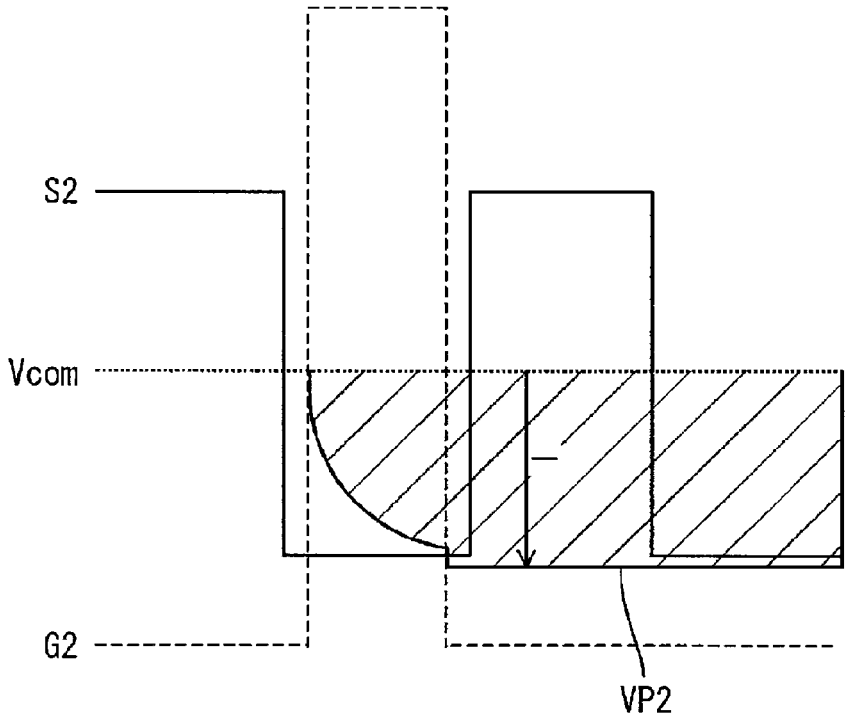
FIG. 4 is a waveform chart showing an example of the liquid crystal driving waveform obtained in the liquid crystal display device of FIG. 1.

FIGS. 3 and 4 are waveform charts each showing an example of a liquid crystal driving waveform. S1 and S2 each indicate a driving waveform of the source voltage (data signal) supplied from the source driver 20. G1 and G2 each indicate a driving waveform of the scanning signal supplied from the gate driver 30. Vcom indicates an electric potential of the counter electrode. VP1 and VP2 each indicate a voltage waveform (pixel electric potential) of the pixel electrode 11.

A voltage applied to a liquid crystal material refers to an electric potential difference between the pixel electrode 11 and the counter electrode 16, and is shown by an oblique line in each of FIGS. 3 and 4. The liquid crystal panel 10 is driven by an alternating current so as to be reliable for a long term. FIG. 3 shows a case where, when an output voltage of the source driver 20 is higher than that of the counter electrode 16, the TFT 13 is turned on in response to an output of the gate driver 30, a positive-polarity voltage with respect to the counter electrode 16 is applied to the pixel electrode 11, and thereafter the TFT 13 is turned off while maintaining its electric potential.

Meanwhile, FIG. 4 shows a case where, when the output voltage of the source driver 20 is lower than that of the counter electrode 16, the TFT 13 is turned on in response to the output of the gate driver 30, a negative-polarity voltage with respect to the counter electrode 16 is applied to the pixel electrode 11, and thereafter the TFT 13 is turned off while maintaining its electric potential. As described above, in a case where a waveform voltage of FIG. 3 and a waveform voltage of FIG. 4 are alternately applied, it is possible to drive the liquid crystal panel by alternating a voltage applied to the liquid crystal display material.

Figure 5:
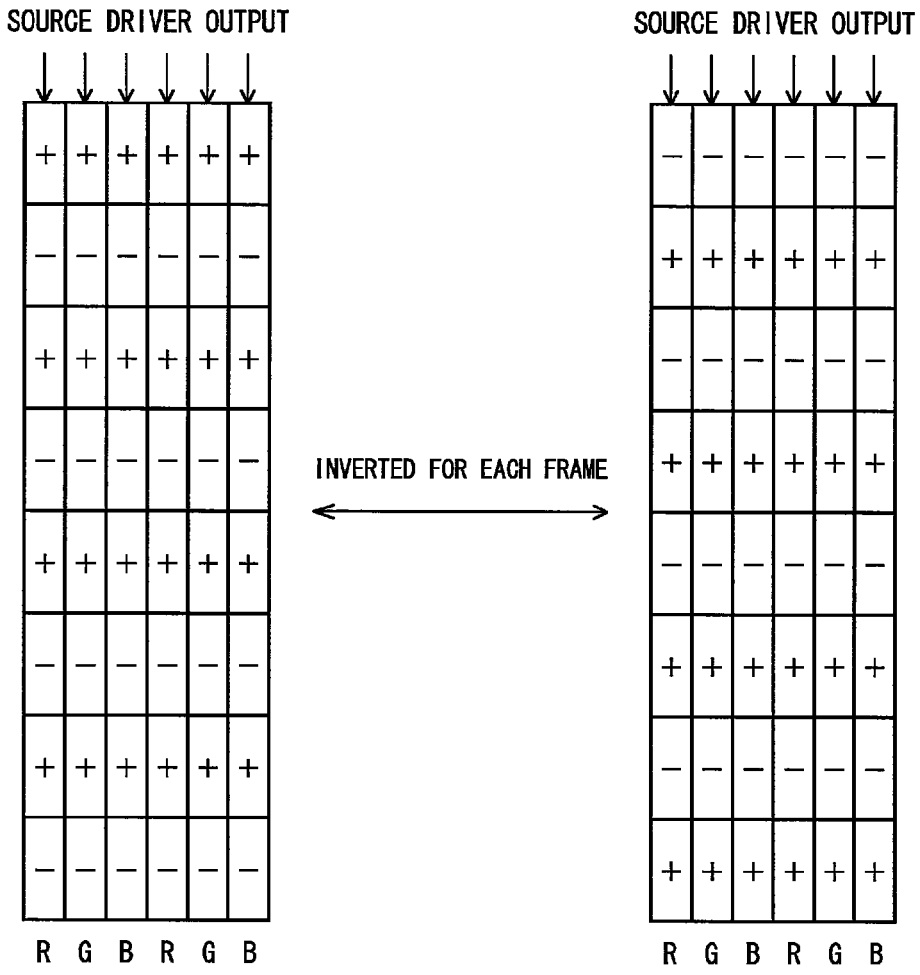
FIG. 5 shows a polarity state of a display of the liquid crystal panel in the liquid crystal display device of FIG. 1.

FIG. 5 shows an example of how polarities are arranged so as to alternate a driving voltage on the liquid crystal panel 10. Here, a line inversion driving method is taken as an example. According to the line inversion driving method, pixels in a display screen (frame) have identical polarities in a row direction (direction in which the gate line extends) and have reversed polarities for every n line(s) (n is an integer of 1 or more) in a column direction (direction in which the source line extends), and the polarities are reversed for each frame. According to this method, in an identical horizontal scanning period, voltages (data signals) having identical polarities (positive or negative polarities) are outputted via all output terminals of the source driver 20. Note that one-line inversion driving is carried out in a case where the polarities are reversed for each line (n=1) in the column direction and that two-line inversion driving is carried out in a case where the polarities are reversed for every two lines (n=2) in the column direction. Furthermore, the line inversion driving method includes not only the case where the polarities are reversed for each frame but also a case where the polarities are reversed for every plurality of frames.

Figure 6:
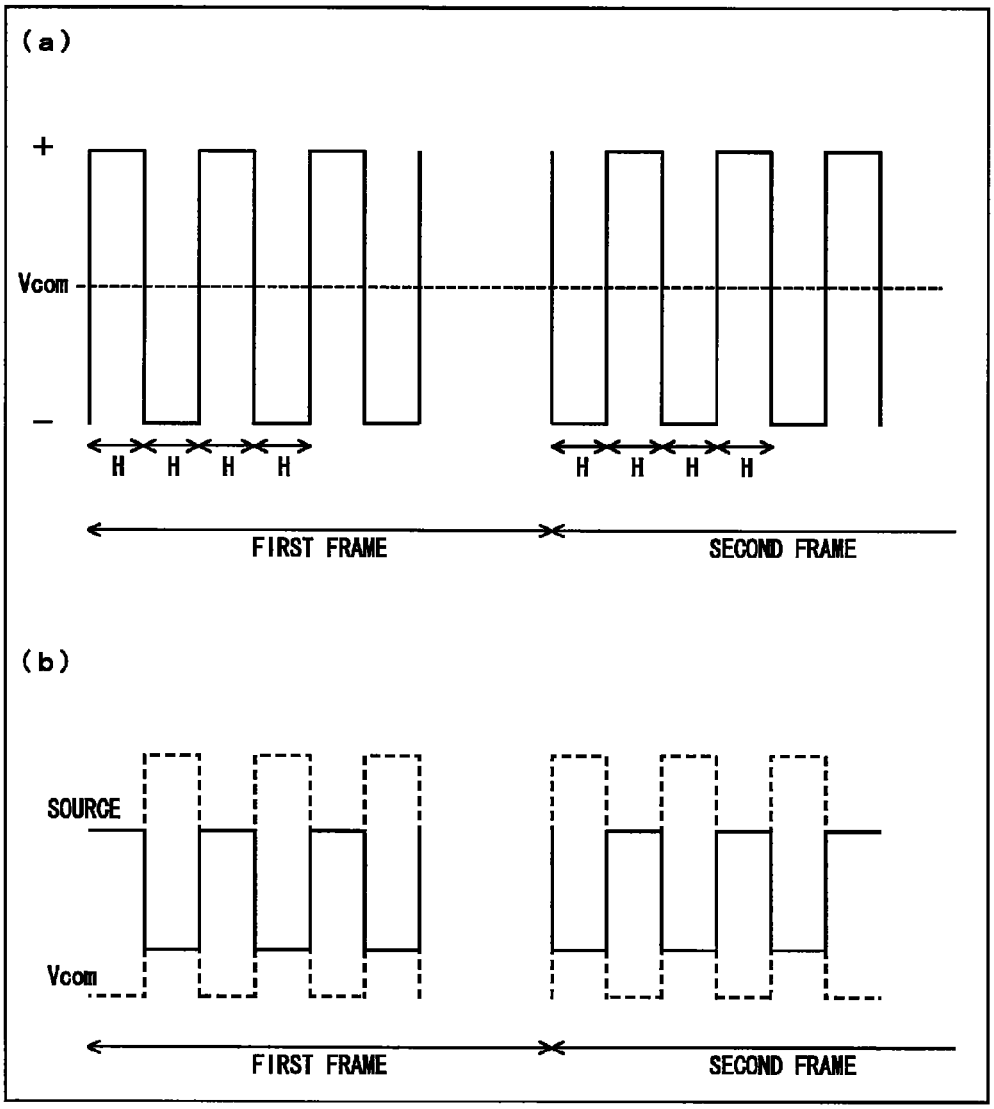
FIG. 6 shows a driving waveform of a source driver in a line inversion driving method (one-line inversion driving) in the liquid crystal display device of FIG. 1. (a) of FIG. 6 shows a case where Vcom is constant and (b) of FIG. 6 shows a case where Vcom is a signal having a rectangular wave.

FIG. 6 shows an example of a driving waveform of the source driver 20 in the line inversion driving method (one-line inversion driving). (a) of FIG. 6 shows a case where Vcom is constant and signals having positive and negative polarities are alternately outputted for each horizontal scanning period (i.e., for each odd-numbered line and each even-numbered line). Alternatively, Vcom may be a signal having a rectangular wave (see (b) of FIG. 6). The configuration of (b) of FIG. 6 allows a smaller amplitude (source amplitude) of the data signals as compared with the configuration of (a) of FIG. 6. This allows lower electric power consumption.

According to the one-line inversion driving method, voltages that are applied to an odd-numbered line and an even-numbered line, respectively, do not change in polarity in each horizontal scanning period (H), and voltages with respect to the counter electrode 16 that are applied to an odd-numbered line and an even-numbered line, respectively, are reversed in polarity to each other (see FIG. 6).

Note that a method in which the liquid crystal display device 1 of the present invention is driven is not limited to the line inversion driving method but may be a dot inversion driving method.

Figure 7:
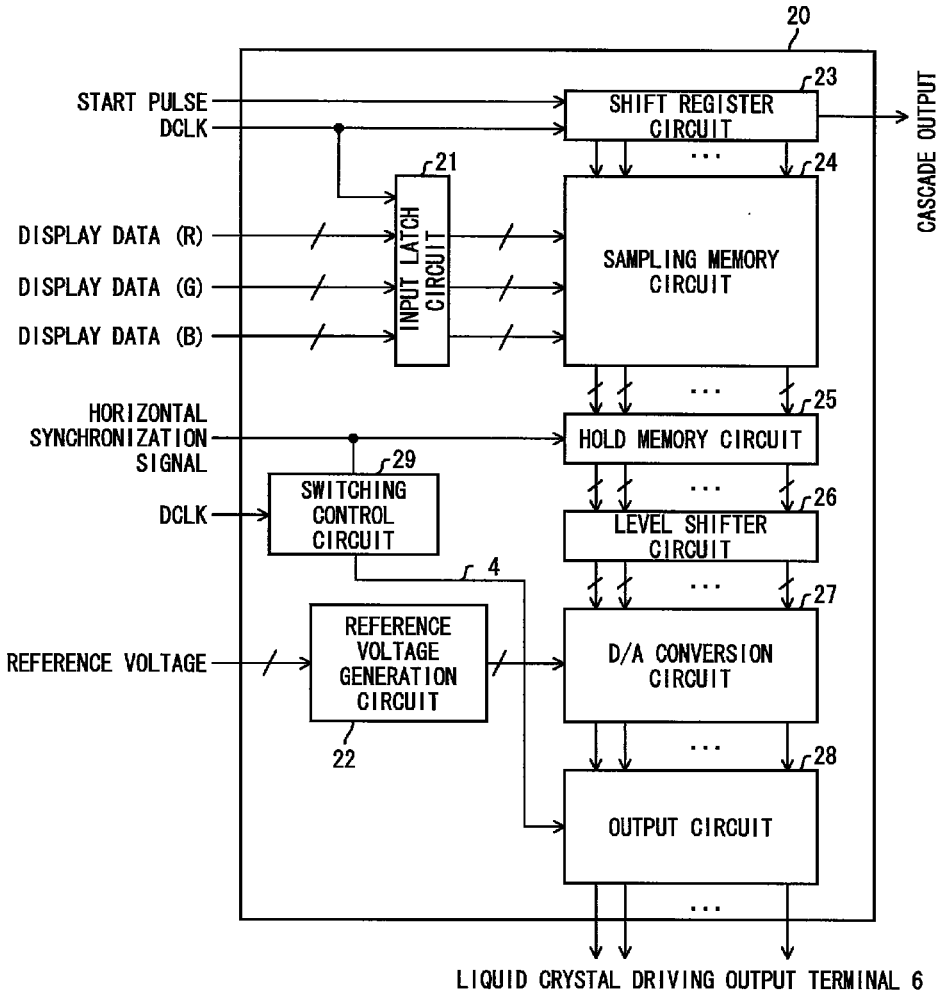
FIG. 7 is a block diagram illustrating a configuration of the source driver in the liquid crystal display device of FIG. 1.

FIG. 7 shows an example of a block diagram illustrating a configuration of the source driver 20 in accordance with the present invention. The source driver 20 includes a shift register circuit 23, a sampling memory circuit 24, a hold memory circuit 25, a level shifter circuit 26, a D/A conversion circuit 27, an output circuit 28, a switching control circuit 29, an input latch circuit 21, and a reference voltage generation circuit 22.

The display data (R, G, and B data) of the digital signal supplied to the source driver 20 are stored in a time-division mode, via the input latch circuit 21, in the sampling memory circuit 24 in response to an operation of the shift register circuit 23. Then, the display data are simultaneously transmitted to the hold memory circuit 25 in accordance with the horizontal synchronization signal. Note that the shift register circuit 23 operates in response to a start pulse and a data clock DCLK and that the input latch circuit 21 operates in response to the data clock DCLK. The data of the hold memory 25 are converted into an analog voltage by the D/A conversion circuit 27 via the level shifter circuit 26. Then, the output circuit 28 outputs, via the liquid crystal driving output terminal, the analog voltage as a tone display driving voltage (liquid crystal driving voltage). Note that the display data are latched and maintained by the hold memory circuit 25 during a horizontal synchronization period. Then, new display data are acquired and latched in accordance with the next horizontal synchronization signal.

(Differential Amplifier Circuit)

Figure 8:
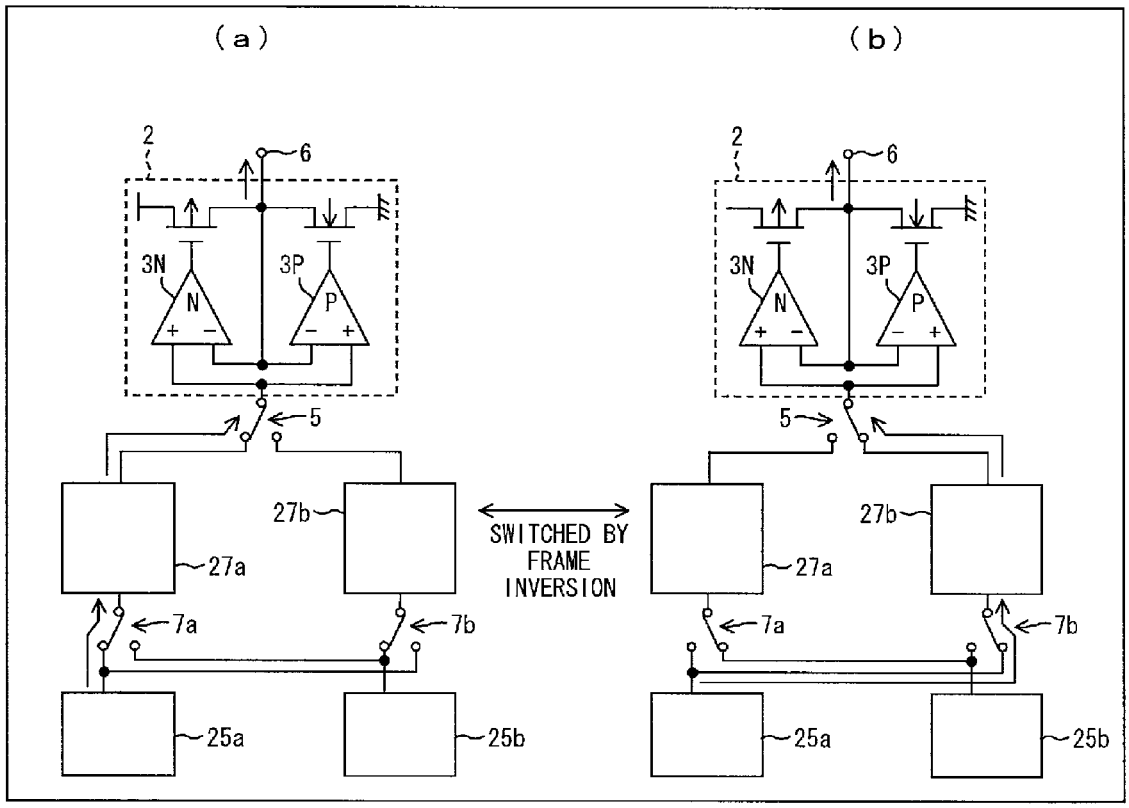
FIG. 8 is a block diagram illustrating a hold memory circuit, a D/A conversion circuit, and a part of an output circuit, each of which is illustrated in FIG. 7.

FIG. 8 illustrates hold memory circuits 25*a* and 25*b* (correspond to the hold memory circuit 25 of FIG. 7), D/A conversion circuits 27*a* and 27*b* (correspond to the D/A conversion circuit 27 of FIG. 7), and an operational amplifier 2 which constitutes the output circuit 28 of FIG. 7. Note that FIG. 8 shows a circuit corresponding to one of liquid crystal driving output terminals 6 of FIG. 7. The D/A conversion circuit 27*a* carries out digital/analog conversion with respect to a positive-polarity voltage. The D/A conversion circuit 27*b* carries out digital/analog conversion with respect to a negative-polarity voltage. Furthermore, the hold memory circuits 25*a* and 25*b* maintain the display data (R, G, and B data).

The output circuit 28 includes a plurality of operational amplifiers 2 corresponding to the respective output terminals 6. The reference numeral 3N of FIG. 8 indicates an N-channel MOS input operational amplifier, and the reference numeral 3P indicates a P-channel MOS input operational amplifier.

Note here that a conventional configuration is applicable to a differential amplifier circuit in accordance with the present invention which differential amplifier circuit includes the operational amplifier 2. That is, the differential amplifier circuit illustrated in FIG. 23 is applicable to a differential amplifier circuit in accordance with the present invention which differential amplifier circuit is constituted by one N-channel MOS input operational amplifier 3N, and the differential amplifier circuit illustrated in FIG. 28 is applicable to a differential amplifier circuit in accordance with the present invention which differential amplifier circuit is constituted by one P-channel MOS input operational amplifier 3P. Note that, in a case where the differential amplifier circuit illustrated in FIG. 23 is applied to the present invention, the in-phase input terminal 110 corresponds to a + input terminal of the operational amplifier 3N illustrated in FIG. 8 and that the antiphase input terminal 111 corresponds to a − input terminal of the operational amplifier 3N illustrated in FIG. 8. Meanwhile, in a case where the differential amplifier circuit illustrated in FIG. 28 is applied to the present invention, the in-phase input terminal 610 corresponds to a + input terminal of the operational amplifier 3P illustrated in FIG. 8, and the antiphase input terminal 611 corresponds to a − input terminal of the operational amplifier 3P illustrated in FIG. 8.

Alternatively, the differential amplifier circuit illustrated in FIG. 33 is applicable to the differential amplifier circuit in accordance with the present invention which differential amplifier circuit is constituted by one N-channel MOS input operational amplifier 3N, and the differential amplifier circuit illustrated in FIG. 34 is applicable to the differential amplifier circuit in accordance with the present invention which differential amplifier circuit is constituted by one P-channel MOS input operational amplifier 3P. Note that, in a case where the differential amplifier circuit illustrated in FIG. 33 is applied to the present invention, the in-phase input terminal 1110 corresponds to the + input terminal of the operational amplifier 3N illustrated in FIG. 8 and that the antiphase input terminal 1111 corresponds to the − input terminal of the operational amplifier 3N illustrated in FIG. 8. Meanwhile, in a case where the differential amplifier circuit illustrated in FIG. 34 is applied to the present invention, the in-phase input terminal 1210 corresponds to the + input terminal of the operational amplifier 3P illustrated in FIG. 8, and the antiphase input terminal 1211 corresponds to the − input terminal of the operational amplifier 3P illustrated in FIG. 8.

The switching signal 114 of FIG. 23, the switching signal 614 of FIG. 28, the switching signal 1114 of FIG. 33, and the switching signal 1214 of FIG. 34 each correspond to an offset switching signal 4 of the source driver 20 (see FIG. 7). The switching switches 106 and 107 of FIG. 23, and the switching switches 606 and 607 of FIG. 28, the switching switches 1106 and 1107 of FIG. 33, and the switching switches 1206 and 1207 of FIG. 34 each correspond to a switching circuit of the present invention. The switching circuit of the present invention selectively switches, in accordance with the offset switching signal 4 (see FIG. 7), two input signals (an in-phase input signal and an antiphase input signal) to be supplied to each of the operational amplifiers 3N and 3P, and supplies the input signals to each of the operational amplifiers 3N and 3P.

Since an operation of the differential amplifier circuit in accordance with the present invention is identical to those illustrated in FIGS. 24, 25, 29 and 30, a description thereof is omitted here. Note that switches 5, and 7*a* and 7*b* of FIG. 8, each of which indicates an output alternation switch for switching a polarity of an output voltage of a liquid crystal driving output, are alternately switched by frame inversion (see (a) and (b) of FIG. 8). In the case of the one-line inversion driving, (a) and (b) of FIG. 8 are alternately switched for each frame and for each horizontal scanning period (for each line). Meanwhile, in the case of the two-line inversion driving, (a) and (b) of FIG. 8 are alternately switched for each frame and for every two horizontal scanning periods (for every two lines).

(Prevention of Flicker)

Here, it is generally known that a differential amplifier circuit has an offset voltage due to a difference in characteristic between elements which constitute the differential amplifier circuit (described earlier). In this regard, in a case where a conventional differential amplifier circuit is applied to a liquid crystal drive circuit (source driver) and an offset voltage is canceled as described with reference to, for example, FIGS. 26 and 27, display unevenness can be prevented. However, even if the display unevenness can be avoided, in a case where the offset voltage is large and a switching cycle (frequency of the switching signal 114) of a selected one of a positive-polarity offset voltage and a negative-polarity offset voltage is long (e.g., in the case of one horizontal scanning period), a flicker may occur in an entire display screen.

In contrast, according to the source driver 20 in accordance with the present invention, since the differential amplifier circuit is identical in configuration to the conventional differential amplifier circuit, the display unevenness can be prevented. Further, since the source driver 20 in accordance with the present invention includes a specific configuration different from the conventional configuration, the occurrence of the flicker can also be prevented. The following description discusses a configuration of the source driver 20 in which configuration occurrence of a flicker is prevented.

According to the source driver 20 in accordance with the present invention, the offset switching signal 4 supplied from the switching control circuit 29 (see FIG. 7) is higher in frequency than at least a horizontal synchronization signal. For example, the offset switching signal 4 is identical in frequency to the data clock DCLK, or has a frequency of the data clock DCLK of 1/m (m is an integer of 1 or more). The following description discusses the switching control circuit 29 and the differential amplifier circuit.

Figure 9:
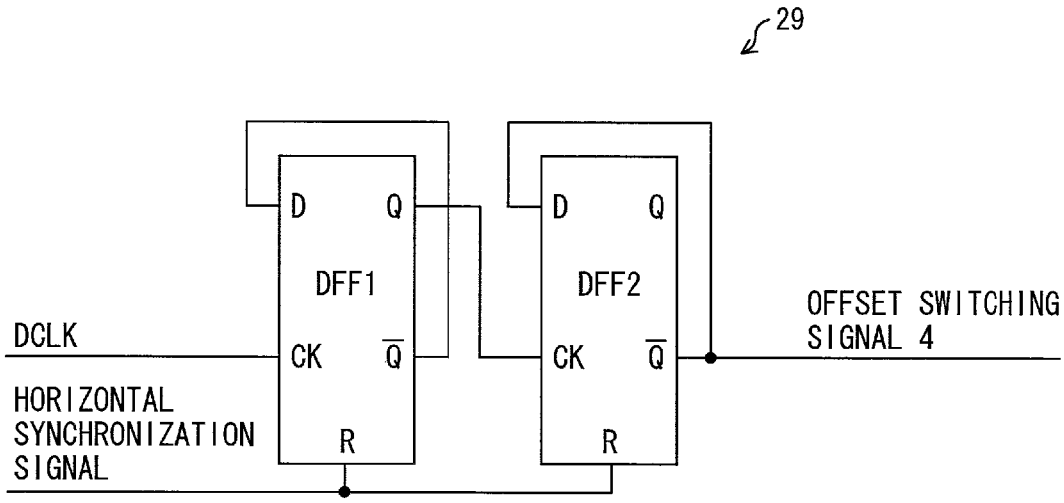
FIG. 9 is a circuit diagram illustrating an example of a configuration of a switching control circuit in the source driver of FIG. 7.

FIG. 9 is a circuit diagram illustrating an example of a configuration of the switching control circuit 29. FIG. 9 shows a configuration in which a frequency of the data clock DCLK is divided into ¼. Specifically, the switching control circuit 29 is constituted by two D flip-flop circuits (DFF1 and DFF2). The DFF1 and the DFF2 have respective input terminals D connected to respective output terminals /Q thereof. The data clock DCLK is supplied to a clock input terminal CK of the DFF1, and an output of an output terminal Q of the DFF1 is supplied to a clock input terminal CK of the DFF2 in the next stage. Then, the offset switching signal 4 is outputted via an output terminal /Q of the DFF2. Note that not only the configuration illustrated in FIG. 9 but also a well-known configuration may be employed as the configuration of the switching control circuit 29 in which configuration the frequency of the data clock DCLK is divided. Furthermore, not only the data clock DCLK but also another signal may be supplied to each of the clock input terminals CK of the switching control circuit 29. That is, the switching control circuit 29 is configured to generate, in accordance with an input signal, the offset switching signal 4 having a higher frequency than the horizontal synchronization signal.

Figure 10:
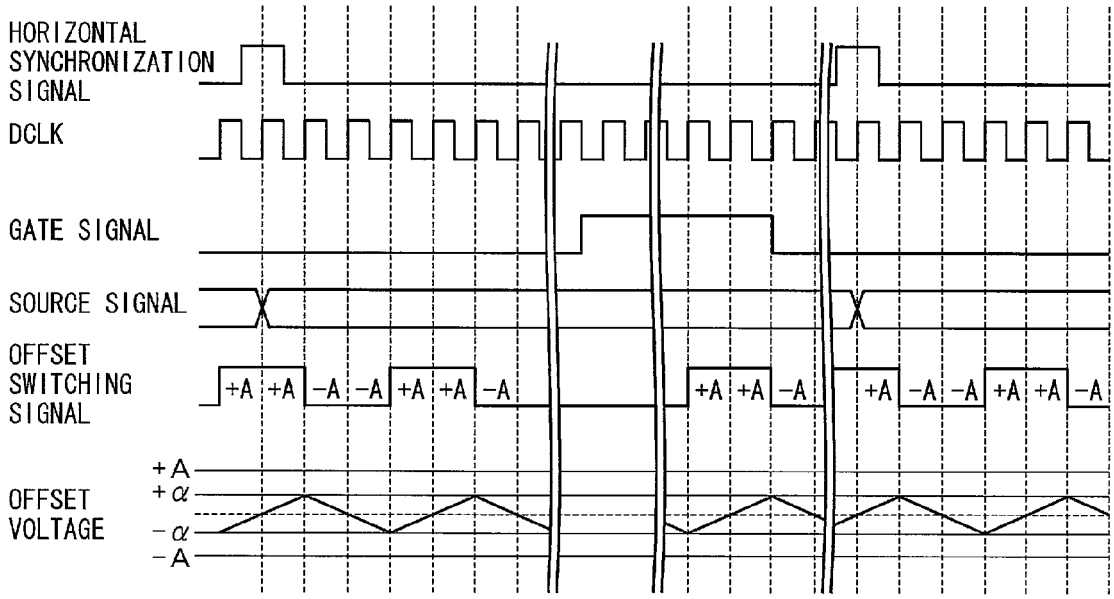
FIG. 10 is a timing chart showing an input signal waveform and an output signal waveform of the switching control circuit and an operational amplifier in the source driver of FIG. 7.

Next, FIG. 10 is a timing chart showing an input signal waveform and an output signal waveform of the switching control circuit 29 and the differential amplifier circuit. FIG. 10 shows a change in the horizontal synchronization signal, the data clock DCLK, the scanning signal (gate signal), a source signal (data signal electric potential), the offset switching signal 4, and an offset voltage.

According to an example of FIG. 10, a high level (H: a first electric potential) or a low level (L: a second electric potential) of the offset switching signal 4 supplied from the switching control circuit 29 (see FIG. 7) is switched at a frequency that is a quarter of the frequency of the data clock DCLK. Assume that the differential amplifier circuit illustrated in FIG. 23 is applied to the present invention. In this case, for example, when the offset switching signal 4 is at the high level, a state of FIG. 24 is selected, whereas, when the offset switching signal 4 is at the low level, a state of FIG. 25 is selected. Note here that an offset voltage in the state of FIG. 24 is referred to as +A, and an offset voltage in the state of FIG. 25 is referred to as −A.

Here, the differential amplifier circuit characteristically requires (i) a given time between when +A is selected as the offset voltage and when a voltage level of the offset voltage reaches +A, and (ii) a given time between when −A is selected as the offset voltage and when the voltage level of the offset voltage reaches −A.

Accordingly, for example, in a case where the offset switching signal 4 is switched from the high level to the low level in a period between when +A is selected as the offset voltage and when the voltage level of the offset voltage reaches +A, the offset voltage decreases in voltage level toward −A before the voltage level reaches +A. Similarly, in a case where the offset switching signal 4 is switched from the low level to the high level in a period between when −A is selected as the offset voltage and when the voltage level of the offset voltage reaches −A, the offset voltage increases in voltage level toward +A before the voltage level reaches −A.

Figure 11:
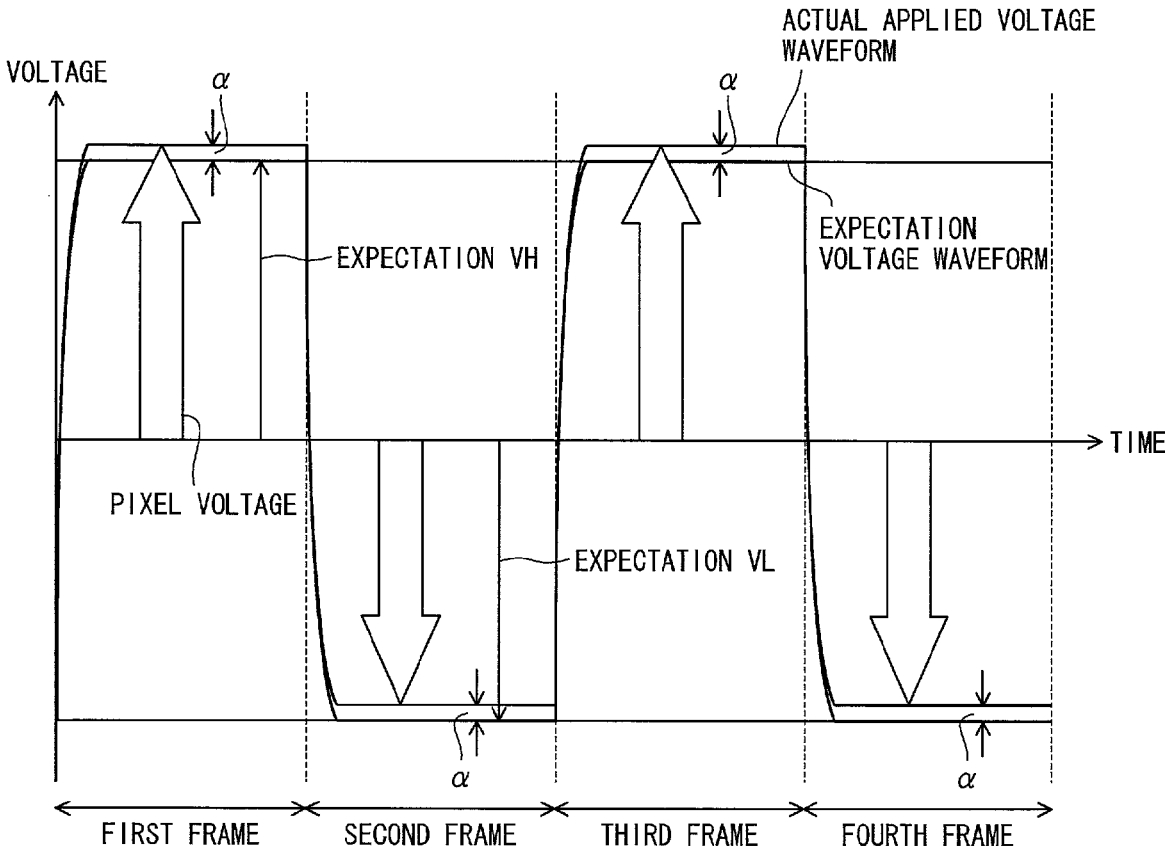
FIG. 11 is a waveform chart showing an example of a liquid crystal driving voltage waveform obtained in the liquid crystal display device of FIG. 1.

Therefore, in a case where a cycle in which the offset voltage is switched (the frequency of the offset switching signal 4) made shorter enough to prevent the offset voltage from reaching +A or −A, it is possible to reduce a voltage level (offset voltage a) added to a source voltage level which is actually applied to a pixel electrode (it is possible to satisfy $|\pm\alpha|<|\pm A|$) (see FIG. 11). In FIG. 10, the offset voltage is $+\alpha(<+A)$ at a timing at which the gate signal falls and a source voltage level which is supplied to the pixel electrode 11 is determined.

This configuration makes it possible to reduce a deviation from an expectation voltage in the horizontal scanning period. That is, the configuration allows a voltage which is actually applied to a pixel electrode to approach an expectation voltage. This makes it possible to prevent a flicker from occurring in the entire display screen.

The present embodiment is configured such that +A is always selected as the offset voltage (the offset switching signal 4 is set to be at the high level "H") at the beginning of each horizontal scanning period (H). Note that the present embodiment may also be configured such that −A is always selected as the offset voltage (the offset switching signal 4 is set to be at the high level "L") at the beginning of each horizontal scanning period (H). That is, according to the present embodiment, horizontal scanning periods (H) are identical in operation of the offset switching signal 4 (hereinafter treated as a sequence), specifically, operation in which the H level (hereinafter treated as the first electric potential) and the L level (hereinafter treated as a second electric potential) are switched. According to this, in a case where a phase relationship between the horizontal synchronization signal and the timing at which the gate signal falls is always constant, the offset voltage can be standardized at $+\alpha$ or $-\alpha$ in each line (in FIG. 10, the offset voltage is $+\alpha$ in all the lines).

Note that the frequency of the offset switching signal 4 is not limited to a quarter of the frequency of the data clock DCLK but can be appropriately set, in accordance with a characteristic of an operational amplifier, for example, to be identical to the frequency of the data clock DCLK, or as ½ or ⅛ of the frequency of the data clock DCLK.

Figure 12:
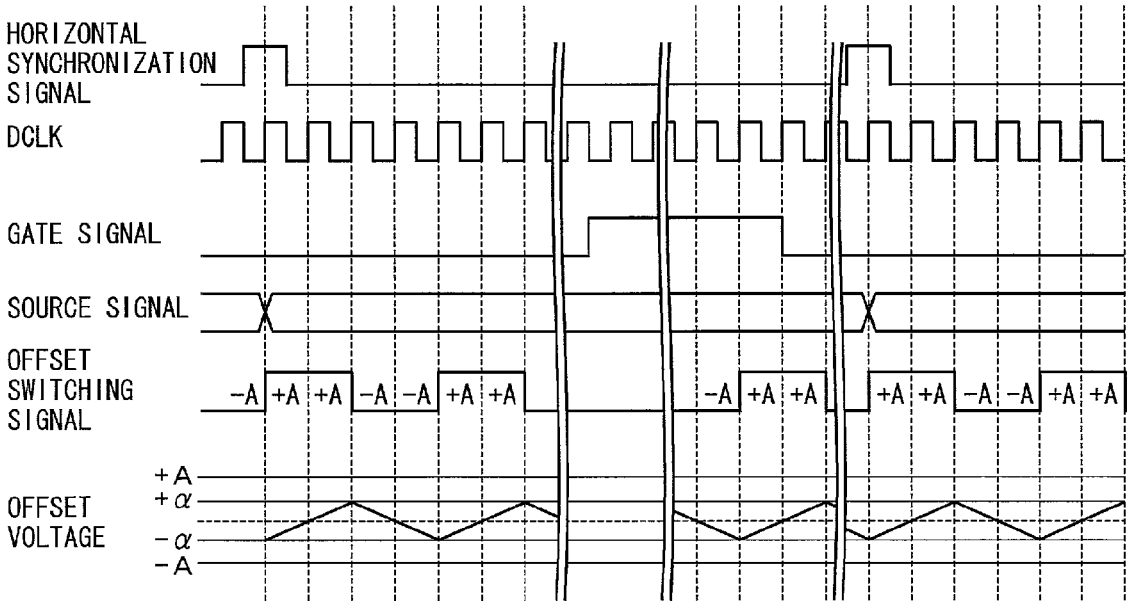
FIG. 12 is a timing chart showing an input signal waveform and an output signal waveform of the switching control circuit and the operational amplifier in the source driver of FIG. 7.
Figure 13:
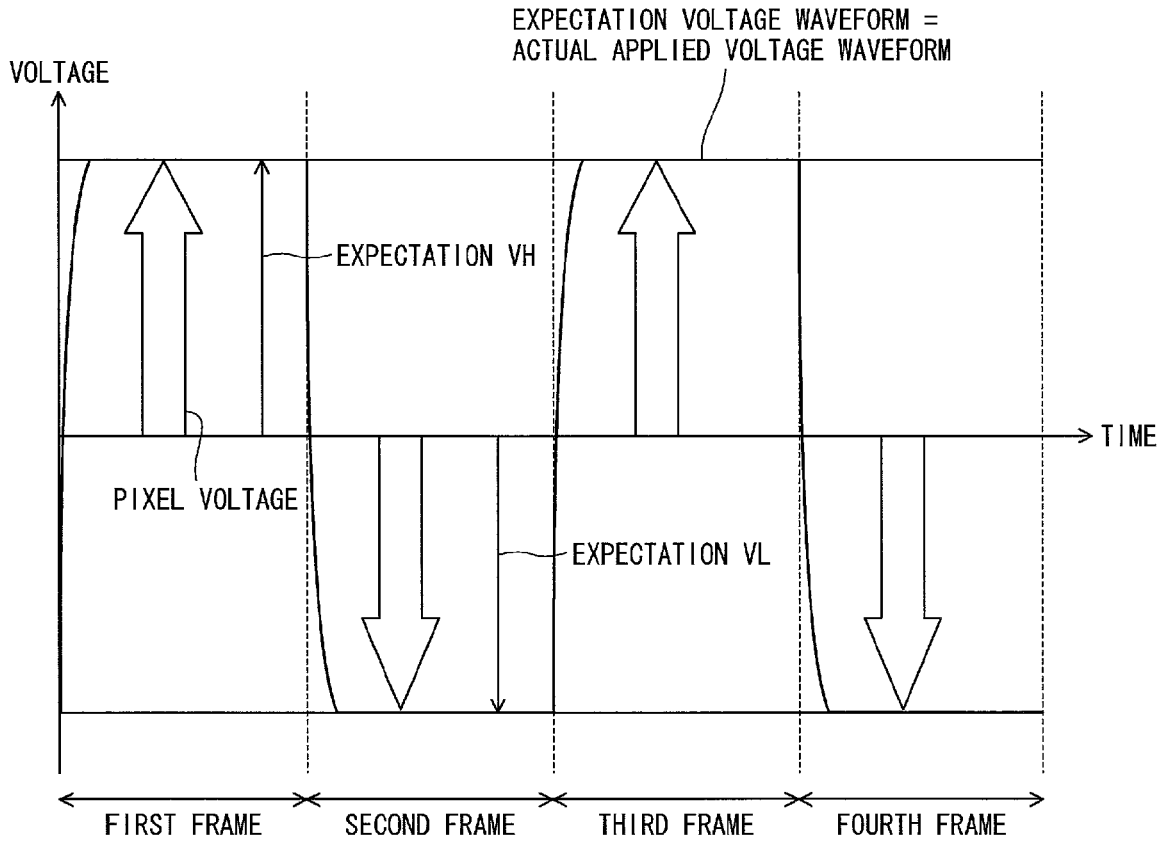
FIG. 13 is a waveform chart showing an example of the liquid crystal driving voltage waveform obtained in the liquid crystal display device of FIG. 1.

Note here that the present embodiment may also be configured such that the offset switching signal 4 is switched so that the offset voltage has an average value (center electric potential) of +A and −A at the timing at which the gate signal falls (see FIG. 12). This allows the offset voltage which is actually added to the source voltage level to theoretically be 0 (zero) (allows an equation of actual source applied voltage=expectation voltage to be satisfied) (see FIG. 13). Therefore, it is possible to prevent occurrence of a flicker without fail.

The following description discusses Modifications of the switching control circuit 29 and the differential amplifier circuit of the present invention.

(Modification 1)

Modification 1 assumes that the one-line inversion driving is carried out. Any odd-numbered line in any odd-numbered frame and any even-numbered line in any even-numbered frame are in a state of a positive polarity (+), and the any even-numbered line in the any odd-numbered frame and the any odd-numbered line in the any even-numbered frame are in a state of a negative polarity (−) (see (a) of FIG. 14).

The switching control circuit 29 in accordance with Modification 1 is configured such that the offset voltage switches between +A and −A at the beginning of the horizontal scanning period (H) for every two lines. That is, the operation (sequence) of the offset switching signal 4 varies for every two lines (here, the voltage level of the offset switching signal 4 is inverted for every two lines). For example, the switching control circuit 29 of the present modification is configured such that +A is selected as the offset voltage at the beginning of the horizontal scanning period in the first and second lines (the offset switching signal 4 is set to be at the high level (H level)), and −A is selected as the offset voltage at the beginning of the horizontal scanning period in the third and fourth lines (the offset switching signal 4 is set to be at the low level (L level)).

(a) of FIG. 14 shows, for the first to fifth lines, (i) a polarity state of a display screen in each of the first and second frames and (ii) how the offset switching signal 4 changes during the horizontal scanning period in each line. In (a) of FIG. 14, "H" indicates +A (high level) selected as the offset voltage, and "L" indicates −A (low level) selected as the offset voltage. One period of "H (or L)" corresponds to a cycle of the data clock DCLK. Accordingly, the frequency of the offset switching signal 4 is equivalent to a quarter of the frequency of the data clock DCLK here. Furthermore, (b) of FIG. 14 shows, for the (4M+1)th line to the (4M+4)th line, (i) the polarity state of the display screen in the first frame and (ii) an offset state in the each line. Note that in (b) of FIG. 14, the offset state is +α in the each of the (4M+1)th line and the (4M+2)th line, and the offset state is −α in each of the (4M+3)th line and the (4M+4)th line. However, the each line and the offset state may be in an inverted relationship depending on the timing at which the gate signal falls. That is, (b) of FIG. 14 shows that the offset state varies for every two lines.

Furthermore, a timing chart corresponding to the first and second lines is identical to that of FIG. 10. FIG. 15 is a timing chart corresponding to the third and fourth lines. According to the present modification, a polarity of the offset voltage which polarity is selected at the timing at which the gate signal falls varies for every two lines (see +α, −α in FIGS. 14, 10, and 15).

Note here that, in a case where an offset direction is random for each of operational amplifiers, since the states of +α and −α are equivalent to each other, respective offset voltages of the operational amplifiers cancel each other in the entire screen, so that a flicker is prevented from occurring in the entire screen. However, in a case where the offset direction inclines for each operational amplifier, e.g., in all or many of a plurality of adjacent operational amplifiers are identical in offset direction, or in a case where an offset direction inclines to any direction in a chip, two states: an offset state of "positive polarity and +α"; and an offset state of "negative polarity and +α" are alternately repeated in a group of the adjacent operational amplifiers. This causes the repetition to be easily recognized as a flicker.

In this regard, according to Modification 1, four states: the offset state of "positive polarity and +α"; the offset state of "negative polarity and +α"; an offset state of "positive polarity and −α"; and an offset state of "negative polarity and −α" are alternately repeated. As compared to the above case, this case further complicates a cycle of the repetition of the offset states and causes the offset direction to disperse. This causes a flicker to be less easily recognized in the entire screen.

(Modification 2)

Modification 2 assumes that the two-line inversion driving is carried out. The first and second lines in any odd-numbered frame and the third and fourth lines in any even-numbered frame are in a state of a positive polarity (+), and the third and fourth lines in the any odd-numbered frame and the first and second lines in the any even-numbered frame are in a state of a negative polarity (−) (see (a) of FIG. 16).

The switching control circuit 29 in accordance with Modification 2 is configured such that, in the liquid crystal panel 10 in which the two-line inversion driving is carried out, the offset voltage switches between +A and −A at the beginning of the horizontal scanning period (H) for each line. That is, the operation (sequence) of the offset switching signal 4 varies for each line (here, the voltage level of the offset switching signal 4 is inverted for each line). For example, the switching control circuit 29 of the present modification is configured such that +A is selected as the offset voltage at the beginning of the horizontal scanning period in the first and third lines (the offset switching signal 4 is set to be at the high level ("H")), and −A is selected as the offset voltage at the beginning of the horizontal scanning period in the second and fourth lines (the offset switching signal 4 is set to be at the low level ("L")).

(a) of FIG. 16 shows, for the first to fifth lines, (i) a polarity state of a display screen in each of the first and second frames and (ii) how the offset switching signal 4 changes during the horizontal scanning period in each line. In this configuration, the frequency of the offset switching signal 4 is equivalent to a quarter of the frequency of the data clock DCLK here. Furthermore, (b) of FIG. 16 shows, for the (4M+1)th line to the (4M+4)th line, (i) the polarity state of the display screen in the first frame and (ii) an offset state in the each line. (b) of FIG. 16 shows that the offset state varies for each line.

Furthermore, a timing chart corresponding to the first and third lines is identical to that of FIG. 10, and a timing chart corresponding to the second and fourth lines is identical to that of FIG. 15. According to the present modification, a polarity of the offset voltage which polarity is selected at the timing at which the gate signal falls varies for each line (see FIGS. 16, 10, and 15). According to this, as is the case of Modification 1, the offset direction can disperse even in a case where the offset direction inclines, to a certain degree, to an identical direction for every plurality of outputs of the operational amplifiers. This allows further prevention of a flicker.

(Modification 3)

The switching control circuit 29 in accordance with Modification 3 is configured such that in the liquid crystal panel 10 in which the one-line inversion driving is carried out, the offset voltage switches between +A and −A at the beginning of the horizontal scanning period (H) for every two lines, and the offset voltage switches between +A and −A so that an even-numbered terminal and an odd-numbered terminal have different polarities (+A and −A). For example, the switching control circuit 29 of the present modification is configured such that in the first and second lines, +A is selected as the offset voltage (the offset switching signal 4 is set to be at the high level ("H")) at the beginning of the horizontal scanning period at the even-numbered terminal, and −A is selected as the offset voltage (the offset switching signal 4 is set to be at the low level ("L")) at the beginning of the horizontal scanning period at the odd-numbered terminal. Meanwhile, the switching control circuit 29 of the present modification is configured such that in the third and fourth lines, −A is selected as the offset voltage (the offset switching signal 4 is set to be at the low level ("L")) at the beginning of the horizontal scanning period at the even-numbered terminal, and +A is selected as the offset voltage (the offset switching signal 4 is set to be at the high level ("H")) at the beginning of the horizontal scanning period at the odd-numbered terminal.

(a) of FIG. 17 shows, for the first to fifth lines, (i) a polarity state of a display screen in each of the first and second frames and (ii) how the offset switching signal 4 changes during the horizontal scanning period in each line for each odd-numbered terminal and each even-numbered terminal. In this configuration, the frequency of the offset switching signal 4 is equivalent to a quarter of the frequency of the data clock DCLK here. Furthermore, (b) of FIG. 17 shows, for the (4M+1)th line to the (4M+4)th line, (i) the polarity state of the display screen in the first frame and (ii) an offset state in the each line of an odd-numbered terminal and an even-numbered terminal. (b) of FIG. 17 shows that the offset state varies for every two lines and that the even-numbered terminal and the odd-numbered terminal differ in offset state.

Furthermore, a timing chart corresponding to the first and second lines of an odd-numbered output and the third and fourth lines of an even-numbered output are identical to that of FIG. 10, and a timing chart corresponding to the third and fourth lines of the odd-numbered output and the first and second lines of the even-numbered output are identical to that of FIG. 15. According to the present modification, a polarity of the offset voltage which polarity is selected at the timing at which the gate signal falls varies for every two lines, and the even-numbered terminal and the odd-numbered terminal differ in offset state (see FIGS. 17, 10, and 15). According to this, as is the case of Modification 1, the offset direction can disperse even in a case where the offset direction inclines, to a certain degree, to an identical direction for every plurality of outputs of the operational amplifiers. This allows further prevention of a flicker.

As described above, according to the present Modification, all the frames are identical in sequence of the offset switching signal 4 (switching operation in which the H level and the L level are switched) in each line, and the sequence of the offset switching signal 4 varies for every two lines.

Note that according to (a) of FIG. 17, timings at which the offset voltage is selected are set to (i) "HHLL" from the beginning of the horizontal scanning period in the first and second lines of an odd-numbered output in the first frame and in the third and fourth lines of an even-numbered output in the first frame, and (ii) "LLHH" from the beginning of the horizontal scanning period in the third and fourth lines of the odd-numbered output in the first frame and in the first and second lines of the even-numbered output in the first frame. However, the present Modification is not limited to this. The timings at which the offset voltage is selected may be set to (i) "HLLHH" from the beginning of the horizontal scanning period in the first and second lines of the odd-numbered output in the first frame and in the third and fourth lines of the even-numbered output in the first frame, and (ii) "LHHLL" from the beginning of the horizontal scanning period in the third and fourth lines of the odd-numbered output in the first frame and in the first and second lines of the even-numbered output in the first frame.

According to the above discussed embodiment and Modifications 1 through 3, in each line, all the frames are identical in operation (sequence) of the offset switching signal 4, specifically, the switching operation in which the H level (first electric potential) and the L level (second electric potential) are switched. That is, in each line, positive/negative polarity inversion is carried out in two frames, and the two frames are identical in operation of the offset switching signal 4. Accordingly, in each line, the offset voltages of $+\alpha$ (or $-\alpha$) cancel each other in the two frames.

Alternatively, a display device which has (i) a function of, for example, changing a resolution (carrying out an identical display of two or more pixels) and (ii) a plurality of data clock DCLK cycles may be configured to change, in accordance with different data clock DCLK cycles, a frequency division ratio of a data clock DCLK for generating an offset switching signal. This configuration allows an optimum cycle of the offset switching signal 4 for each of the plurality of data clock DCLK cycles.

The display drive circuit in accordance with the embodiment of the present invention may be configured such that the switching control circuit supplies the switching signal to the switching circuit, the switching signal being identical in frequency to a data clock or being obtained by dividing a frequency of the data clock so that the switching signal has a higher frequency than the horizontal synchronization signal.

According to the configuration, the switching control circuit can supply the switching signal having a higher frequency than the horizontal synchronization signal.

The display drive circuit in accordance with the embodiment of the present invention may be configured such that the switching control circuit generates the switching signal in accordance with the horizontal synchronization signal.

According to the configuration, since the switching control circuit can generate the switching signal in accordance with the horizontal synchronization signal, an offset state can be controlled for each horizontal scanning period, so that display unevenness can be prevented for each horizontal scanning period.

The display drive circuit in accordance with the embodiment of the present invention may be configured such that when the switching signal has a first electric potential, a first intrinsic offset voltage that the first amplifier circuit characteristically has is selected; and when the switching signal has a second electric potential, a second intrinsic offset voltage that the second amplifier circuit characteristically has is selected.

The display drive circuit in accordance with the embodiment of the present invention may be configured such that the switching signal has an electric potential that is switched so that: the first electric potential is switched to the second electric potential in a period between when the first electric potential is selected and when an offset voltage that is produced in the first amplifier circuit reaches the first intrinsic offset voltage; and the second electric potential is switched to the first electric potential in a period between when the second electric potential is selected and when an offset voltage that is produced in the second amplifier circuit reaches the second intrinsic offset voltage.

The display drive circuit in accordance with the embodiment of the present invention may be configured such that (i) a first offset voltage that is produced in the first amplifier circuit when the switching signal has the first electric potential and (ii) a second offset voltage that is produced in the second amplifier circuit when the switching signal has the second electric potential differ from each other in polarity.

This configuration allows the offset voltages to cancel each other, so that it is possible to prevent a flicker from occurring in the entire display screen.

The display drive circuit in accordance with the embodiment of the present invention may be configured such that: a first offset voltage that is produced in the first amplifier circuit when the switching signal has the first electric potential is smaller than the first intrinsic offset voltage; and a second offset voltage that is produced in the second amplifier circuit when the switching signal has the second electric potential is smaller than the second intrinsic offset voltage.

The display drive circuit in accordance with the embodiment of the present invention may be configured such that all horizontal scanning periods are identical in sequence of the switching signal.

Note that the sequence of the switching signal specifically refers to an operation in which the first electric potential (e.g., an H level) and the second electric potential (e.g., an L level) of the switching signal are switched.

The display drive circuit may be configured such that all frames are identical in sequence of the switching signal in each line, and the sequence of the switching signal varies for every n line(s) (n is an integer of 1 or more).

The display drive circuit in accordance with the embodiment of the present invention may be configured such that the switching signal has a frequency that is a half or a quarter of the frequency of the data clock.

A display device in accordance with the embodiment of the present invention can further include: the display drive circuit; and a display panel.

The display device in accordance with the embodiment of the present invention may be configured such that the display panel carries out n-line inversion driving (n is an integer of 1 or more).

The present invention is not limited to the description of the embodiment above, but may be altered by a skilled person within the scope of the claims. An embodiment based on a proper combination of technical means disclosed in different embodiments is encompassed in the technical scope of the present invention.

INDUSTRIAL APPLICABILITY

The present invention is suitable for each drive circuit of a display device.

REFERENCE SIGNS LIST

1 Liquid crystal display device (display device)
2 Operational amplifier (differential amplifier circuit)
3N (N-channel MOS input) operational amplifier
3P (P-channel MOS input) operational amplifier
4 Offset switching signal (switching signal)
6 Output terminal
10 Liquid crystal panel (display panel)
20 Source driver (display drive circuit)
30 Gate driver
28 Output circuit
29 Switching control circuit
+A Offset voltage (first intrinsic offset voltage, second intrinsic offset voltage)
−A Offset voltage (first intrinsic offset voltage, second intrinsic offset voltage)
+α Offset voltage (first offset voltage, second offset voltage)
−α Offset voltage (first offset voltage, second offset voltage)
DCLK Data clock

The invention claimed is:

1. A display drive circuit comprising:

a first amplifier circuit and a second amplifier circuit each amplifying either one of two input signals that are in-phase and antiphase;

a switching circuit which selectively switches the two input signals in accordance with a switching signal and supplies the two input signals thus switched to the first amplifier circuit and the second amplifier circuit, respectively; and a switching control circuit which controls switching of the switching circuit by supplying the switching signal to the switching circuit, wherein the switching control circuit supplies the switching signal to the switching circuit, the switching signal having a higher frequency than a horizontal synchronization signal;

when the switching signal has a first electric potential, a first intrinsic offset voltage that is a characteristic of the first amplifier circuit is selected by the switching control circuit;

when the switching signal has a second electric potential, a second intrinsic offset voltage that is a characteristic of the second amplifier circuit is selected by the switching control circuit; and the switching signal has an electric potential that is switched so that:

after the first electric potential is selected, the first electric potential is switched to the second electric potential before an offset voltage produced in the first amplifier circuit reaches the first intrinsic offset voltage; and after the second electric potential is selected, the second electric potential is switched to the first electric potential before an offset voltage produced in the second amplifier circuit reaches the second intrinsic offset voltage.

2. The display drive circuit as set forth in claim 1, wherein the switching control circuit supplies the switching signal to the switching circuit, the switching signal being identical in frequency to a data clock or being obtained by dividing a frequency of the data clock so that the switching signal has a higher frequency than the horizontal synchronization signal.

3. The display drive circuit as set forth in claim 1, wherein the switching control circuit generates the switching signal in accordance with the horizontal synchronization signal.

4. The display drive circuit as set forth in claim 1, wherein (i) a first offset voltage that is produced in the first amplifier circuit when the switching signal has the first electric potential and (ii) a second offset voltage that is produced in the second amplifier circuit when the switching signal has the second electric potential differ from each other in polarity.

5. The display drive circuit as set forth in claim 1, wherein:

a first offset voltage that is produced in the first amplifier circuit when the switching signal has the first electric potential is smaller than the first intrinsic offset voltage; and a second offset voltage that is produced in the second amplifier circuit when the switching signal has the second electric potential is smaller than the second intrinsic offset voltage.

6. The display drive circuit as set forth in claim 1, wherein all horizontal scanning periods are identical in sequence of the switching signal.

7. The display drive circuit as set forth in claim 1, wherein all frames are identical in sequence of the switching signal in each line, and the sequence of the switching signal varies for every n line(s) (n is an integer of 1 or more).

8. The display drive circuit as set forth in claim 2, wherein the switching signal has a frequency that is a half or a quarter of the frequency of the data clock.

9. A display device comprising: a display drive circuit recited in claim 1; and a display panel.

10. The display device as set forth in claim 9, wherein the display panel carries out n-line inversion driving (n is an integer of 1 or more).

11. A method for driving a display drive circuit, the display drive circuit including:

a first amplifier circuit and a second amplifier circuit each amplifying either one of two input signals that are in-phase and antiphase;

a switching circuit which selectively switches the two input signals in accordance with a switching signal and supplies the two input signals thus switched to the first amplifier circuit and the second amplifier circuit, respectively; and a switching control circuit which controls switching of the switching circuit by supplying the switching signal to the switching circuit, said method comprising:

causing the switching control circuit to supply the switching signal to the switching circuit, the switching signal having a higher frequency than a horizontal synchronization signal; and causing the switching control circuit to supply the switching signal with an electric potential that is switched so that:

after a first electric potential is selected, the first electric potential is switched to a second electric potential before an offset voltage that is produced in the first amplifier circuit reaches a first intrinsic offset voltage, the first intrinsic offset voltage being a characteristic of the first amplifier circuit; and after the second electric potential is selected, the second electric potential is switched to the first electric potential before an offset voltage that is produced in the second amplifier circuit reaches a second intrinsic offset voltage, the second intrinsic offset voltage being a characteristic of the second amplifier circuit.

12. The display device as set forth in claim 9, wherein the switching circuit is switched by the switching control circuit in a period in which an output voltage from the display drive circuit is applied to a pixel electrode of a pixel of the display panel.

* * * * *